US010303071B2

(12) United States Patent
Takeda et al.

(10) Patent No.: US 10,303,071 B2
(45) Date of Patent: May 28, 2019

(54) TONER, DEVELOPER, IMAGE FORMING APPARATUS, AND PROCESS CARTRIDGE

(71) Applicants: Hiroyuki Takeda, Kanagawa (JP); Junichi Awamura, Shizuoka (JP); Hiroshi Yamada, Shizuoka (JP); Akira Tanaka, Shizuoka (JP)

(72) Inventors: Hiroyuki Takeda, Kanagawa (JP); Junichi Awamura, Shizuoka (JP); Hiroshi Yamada, Shizuoka (JP); Akira Tanaka, Shizuoka (JP)

(73) Assignee: Richoh Company, Ltd., Tokyo (JP)

( * ) Notice: Subject to any disclaimer, the term of this patent is extended or adjusted under 35 U.S.C. 154(b) by 0 days.

(21) Appl. No.: 15/874,014

(22) Filed: Jan. 18, 2018

(65) Prior Publication Data

US 2018/0253022 A1 Sep. 6, 2018

(30) Foreign Application Priority Data

Mar. 1, 2017 (JP) ..... 2017-038291

(51) Int. Cl.

| | |
|---|---|
| ***G03G 9/08*** | (2006.01) |
| ***G03G 9/087*** | (2006.01) |
| ***G03G 9/09*** | (2006.01) |
| *G03G 21/18* | (2006.01) |
| *G03G 15/20* | (2006.01) |

(52) U.S. Cl.

CPC ..... *G03G 9/08755* (2013.01); *G03G 9/0821* (2013.01); *G03G 9/091* (2013.01); *G03G 9/0906* (2013.01); *G03G 9/0918* (2013.01); *G03G 15/2064* (2013.01); *G03G 21/18* (2013.01)

(58) Field of Classification Search

CPC ..... G03G 9/08755; G03G 9/0821
USPC ..... 430/109.4, 111.4
See application file for complete search history.

(56) References Cited

U.S. PATENT DOCUMENTS

| | | | | |
|---|---|---|---|---|
| 2002/0192586 | A1* | 12/2002 | Kubo | G03G 9/0819 430/109.4 |
| 2004/0131961 | A1 | 7/2004 | Watanabe et al. | |
| 2016/0187795 | A1 | 6/2016 | Saitoh et al. | |
| 2016/0370720 | A1 | 12/2016 | Yamashita et al. | |
| 2017/0017175 | A1 | 1/2017 | Yamada et al. | |
| 2017/0108791 | A1 | 4/2017 | Hashida et al. | |

FOREIGN PATENT DOCUMENTS

| | | |
|---|---|---|
| JP | 11-295918 | 10/1999 |
| JP | 2004-117912 | 4/2004 |
| JP | 2004-151438 | 5/2004 |
| JP | 2004-212739 | 7/2004 |
| JP | 2015-045669 | 3/2015 |

* cited by examiner

*Primary Examiner* — Mark A Chapman
(74) *Attorney, Agent, or Firm* — Oblon, McClelland, Maier & Neustadt, L.L.P.

(57) ABSTRACT

A non-magnetic toner is provided. The non-magnetic toner comprises a polyester resin, a release agent, and a colorant. A storage elastic modulus at 100° C. (G'(100° C.)) of the toner is from $1.0\times10^3$ to $1.0\times10^6$ Pa, and a storage elastic modulus at 160° C. (G'(160° C.)) of the toner is from $1.0\times10^2$ to $1.0\times10^4$ Pa. A ratio of loss elastic modulus to storage elastic modulus at 100° C. (tan δ(100° C.)) of the toner is greater than that at 130° C. (tan δ(130° C.)), and the tan δ(100° C.) and the tan δ(130° C.) are each within the range of from 1 to 2.

17 Claims, 4 Drawing Sheets

TONER, DEVELOPER, IMAGE FORMING APPARATUS, AND PROCESS CARTRIDGE

CROSS-REFERENCE TO RELATED APPLICATIONS

This patent application is based on and claims priority pursuant to 35 U.S.C. § 119(a) to Japanese Patent Application No. 2017-038291, filed on Mar. 1, 2017 in the Japan Patent Office, the entire disclosure of which is hereby incorporated by reference herein.

BACKGROUND

Technical Field

The present disclosure relates to a toner, a developer, an image forming apparatus, and a process cartridge.

Description of the Related Art

In a typical electrophotographic image forming apparatus, a latent image is formed electrically or magnetically and visualized with toner. More specifically, an electrostatic latent image is formed on a photoconductor and developed into a toner image with toner. The toner image is transferred onto a recording medium, such as paper, and fixed thereon. In fixing the toner image on the recording medium, heat fixing methods are widely employed, such as a heat roller fixing method and a heat belt fixing method, for their high energy efficiency.

In recent years, demand for high-speed-printing and energy-saving image forming apparatus is increasing. In accordance with this demand, toner is required to be fixable at lower temperatures while providing higher image quality. In addition, since the field of electrophotography has been expanded, toner is required to meet various needs of consumers. For example, in the production printer market, a high-quality high-reliability toner having excellent color reproducibility is demanded.

SUMMARY

In accordance with some embodiments of the present invention, a non-magnetic toner is provided. The non-magnetic toner comprises a polyester resin, a release agent, and a colorant. A storage elastic modulus at 100° C. (G'(100° C.)) of the toner is from $1.0\times10^3$ to $1.0\times10^6$ Pa, and a storage elastic modulus at 160° C. (G'(160° C.)) of the toner is from $1.0\times10^2$ to $1.0\times10^4$ Pa. A ratio of loss elastic modulus to storage elastic modulus at 100° C. (tan δ(100° C.)) of the toner is greater than that at 130° C. (tan δ(130° C.)), and the tan δ(100° C.) and the tan δ(130° C.) are each within the range of from 1 to 2.

In accordance with some embodiments of the present invention, a developer including the above toner is provided.

In accordance with some embodiments of the present invention, an image forming apparatus is provided. The image forming apparatus includes an electrostatic latent image bearer, a charger to charge a surface of the electrostatic latent image bearer, an irradiator to irradiate the charged surface of the electrostatic latent image bearer to form an electrostatic latent image, a developing device containing the above toner to develop the electrostatic latent image into a toner image with the toner, a transfer device to transfer the toner image onto a recording medium, and a fixing device to fix the toner image on the recording medium.

In accordance with some embodiments of the present invention, a process cartridge detachably mountable to an image forming apparatus is provided. The process cartridge includes an electrostatic latent image bearer and a developing device containing the above toner to develop an electrostatic latent image formed on the electrostatic latent image bearer into a toner image with the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
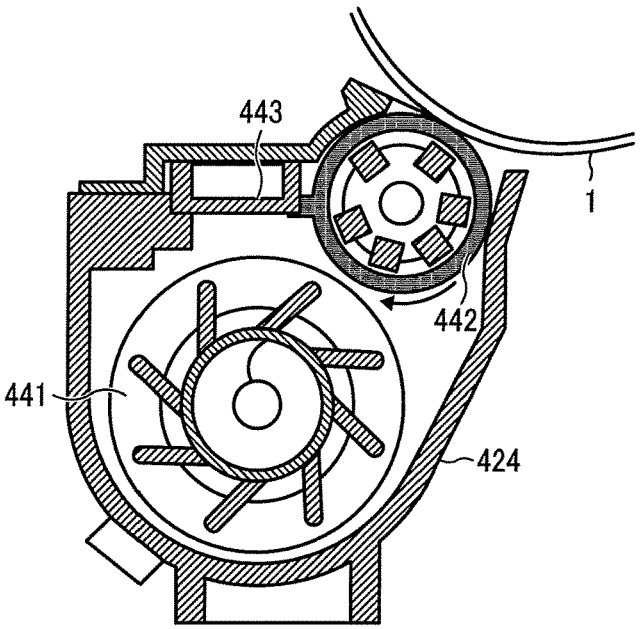
FIG. 1 is a schematic view of a two-component developing device in an image forming apparatus in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In attempting to provide high-gloss toner having excellent low-temperature fixability, a toner produced by a dissolution suspension polymerization containing a modified polyester resin having urethane and/or urea groups has been proposed.

Also, a toner prepared by elongating polyester has also been proposed. In addition, a toner containing a urethane-modified polyester having a low glass transition temperature (Tg) of 0° C. or less and a high-molecular-weight cross-linked structure has also been proposed.

Such toners have attempted to improve gloss and color reproducibility by reducing the glass transition temperature, more sharply melting within the fixable temperature range, or reducing viscoelasticity. However, on the other hand, there still remain problems in heat-resistant storage stability, hot offset resistance, and gloss evenness. Accordingly, toner having excellent color reproducibility, low-temperature fixability, hot offset resistance, heat-resistant storage stability, and gloss evenness has been demanded.

In accordance with some embodiments of the present invention, a toner is provided improved in color reproducibility, low-temperature fixability, hot offset resistance, heat-resistant storage stability, and gloss evenness at high levels.

Toner

The toner in accordance with some embodiments of the present invention comprises a polyester resin as a binder resin. The polyester resin may comprise a plurality of polyester resins. Preferably, the polyester resin comprises a THF-soluble polyester resin (hereinafter "second polyester resin").

The toner further comprises a release agent. Specific examples of the release agent include, but are not limited to, waxes such as carbonyl-group-containing wax, polyolefin wax, and long-chain hydrocarbon wax. Each of these waxes can be used alone or in combination with others. Among these waxes, carbonyl-group-containing wax is preferable.

The toner is a non-magnetic toner comprising a colorant. Examples of the colorant include dyes and pigments. The colorant may have a color such as magenta, cyan, and yellow. Two or more of these colorants can be used in combination.

A storage elastic modulus at 100° C. (hereinafter "G'(100° C.)") of the toner is from $1.0\times10^3$ to $1.0\times10^6$ Pa, and a storage elastic modulus at 160° C. (hereinafter "G'(160° C.)") of the toner is from $1.0\times10^2$ to $1.0\times10^4$ Pa. In addition, the inequality tan δ(100° C.)>tan δ(130° C.) is satisfied, where each of tan δ(100° C.) and tan δ(130° C.) is in the range of from 1 to 2. Here, tan δ(100° C.) and tan δ(130° C.) refer to a ratio of loss elastic modulus to storage elastic modulus of the toner at 100° C. and 130° C., respectively. The above parameters G'(100° C.), G'(160° C.), tan δ(100° C.), and tan δ(130° C.) are each adjustable by varying the composition, combination, or blending ratio of the polyester resins. In particular, for satisfying the inequality tan δ(100° C.)>tan δ(130° C.), it is preferable that the polyester resin comprises: a first polyester resin having a glass transition temperature (Tg) of 0° C. or less (preferably from −40° C. to 0° C.) and exhibiting a relatively low viscoelasticity behavior (e.g., rubber-state behavior) at or above room temperature; and a second polyester resin having a glass transition temperature (Tg) of 20° C. or greater and exhibiting a relatively high viscoelasticity behavior at high temperatures.

When G'(100° C.) is less than $1.0\times10^3$ Pa, heat-resistant storage stability of the toner deteriorates. When G'(100° C.) is greater than $1.0\times10^6$ Pa, low-temperature fixability deteriorates. Within the above-specified range, preferably, G'(100° C.) is $1.0\times10^4$ Pa or greater.

When G'(160° C.) is less than $1.0\times10^2$ Pa, hot offset resistance and gloss evenness of the toner deteriorate. When G'(160° C.) is greater than $1.0\times10^4$ Pa, low-temperature fixability deteriorates. Within the above-specified range, preferably, G'(160° C.) is $1.0\times10^3$ Pa or greater.

When tan δ(100° C.) is less than 1, low-temperature fixability deteriorates. When tan δ(100° C.) is greater than 2, heat-resistant storage stability deteriorates.

When tan δ(130° C.) is less than 1, low-temperature fixability deteriorates. When tan δ(130° C.) is greater than 2, gloss evenness deteriorates and it becomes difficult to achieve low gloss.

When tan δ(100° C.)>tan δ(130° C.) is satisfied, it is possible to achieve low gloss while achieving both low-temperature fixability and heat-resistant storage stability at the same time.

The toner is preferably used in an image forming apparatus including: an electrostatic latent image bearer; a charger to charge a surface of the electrostatic latent image bearer; an irradiator to irradiate the charged surface of the electrostatic latent image bearer to form an electrostatic latent image; a developing device to develop the electrostatic latent image into a toner image with the toner; a transfer device to transfer the toner image onto a recording medium; and a fixing device to fix the toner image on the recording medium. Specifically, the fixing device has a nip portion where the toner image is pressurized on the recording medium for a nip time of 35 msec or more to be fixed thereon. Since the toner exhibits higher viscoelasticity and lower tan δ than conventional toners at high temperatures, when the nip time is less than 35 msec, gloss may be lowered and color reproducibility may be degraded.

Polyester Resin

Preferably, the polyester resin comprises a THF-insoluble urethane-modified and/or urea-modified polyester resin (hereinafter may be referred to as "first polyester resin"). The urethane-modified polyester resin may be obtained by reacting a polyester resin having a terminal isocyanate group with a polyol. The urea modified polyester resin may be obtained by reacting a polyester resin having a terminal isocyanate group with a polyamine.

The polyester resin may be either linear or non-linear. Being non-linear refers to having a branched structure formed with at least one of an alcohol having 3 or more valences and a carboxylic acid having 3 or more valences.

The polyester resin may be obtained by reacting a polyester resin having an active hydrogen group with a polyisocyanate. The polyester resin having an active hydrogen group may be obtained by condensation-polymerizing a diol, a dicarboxylic acid, and at least one of an alcohol having 3 or more valences and a carboxylic acid having 3 or more valences. The alcohol having 3 or more valences and the carboxylic acid having 3 or more valences impart a branched structure to the resultant polyester resin having an isocyanate group.

Specific examples of the diol include, but are not limited to: aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene propylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Each of these diols can be used alone or in combination with others.

Examples of the dicarboxylic acid include, but are not limited to, aliphatic dicarboxylic acids and aromatic dicarboxylic acids. In addition, anhydrides, lower alkyl esters (C1-C3), and halides thereof may also be used.

Specific examples of the aliphatic dicarboxylic acids include, but are not limited to, succinic acid, adipic acid, sebacic acid, dodecanedioic acid, maleic acid, and fumaric acid.

Specific preferred examples of the aromatic dicarboxylic acids include those having 8 to 20 carbon atoms.

Specific examples of the aromatic dicarboxylic acids having 8 to 20 carbon atoms include, but are not limited to, phthalic acid, isophthalic acid, terephthalic acid, and naphthalenedicarboxylic acid. Among these, aliphatic dicarboxylic acids having 4 to 12 carbon atoms are preferable. The content rate of carboxylic acid components in the resin is preferably 50% by mass or more. Each of these dicarboxylic acids can be used alone or in combination with others.

Examples of the alcohol having 3 or more valences include, but are not limited to, aliphatic alcohols having 3 or more valences, polyphenols having 3 or more valences, and alkylene oxide adducts of polyphenols having 3 or more valences.

Specific examples of the aliphatic alcohols having 3 or more valences include, but are not limited to, glycerin, trimethylolethane, trimethylolpropane, pentaerythritol, and sorbitol.

Specific examples of the polyphenols having 3 or more valences include, but are not limited to, trisphenol PA, phenol novolac, and cresol novolac.

Specific examples of the alkylene oxide adducts of polyphenols having 3 or more valences include, but are not limited to, alkylene oxide (e.g., ethylene oxide, propylene oxide, and butylene oxide) adducts of polyphenols having 3 or more valences.

Examples of the carboxylic acid having 3 or more valences include, but are not limited to, aromatic carboxylic acids having 3 or more valences. In addition, anhydrides, lower alkyl esters (C1-C3), and halides thereof may also be used.

Specific preferred examples of the aromatic carboxylic acids having 3 or more valences include those having 9 to 20 carbon atoms. Specific examples of the aromatic carboxylic acids having 3 or more valences and 9 to 20 carbon atoms include, but are not limited to, trimellitic acid and pyromellitic acid.

Examples of the polyisocyanate include, but are not limited to, diisocyanates and isocyanates having 3 or more valences.

Examples of the diisocyanates include, but are not limited to, aliphatic diisocyanates, alicyclic diisocyanates, aromatic diisocyanates, aromatic aliphatic diisocyanates, and isocyanurates, and these diisocyanates blocked with a phenol derivative, oxime, or caprolactam.

Specific examples of the aliphatic diisocyanates include, but are not limited to, tetramethylene diisocyanate, hexamethylene diisocyanate, methyl 2,6-diisocyanatocaproate, octamethylene diisocyanate, decamethine diisocyanate, dodecamethylene diisocyanate, tetradecamethylene diisocyanate, trimethylhexane diisocyanate, and tetramethylhexane diisocyanate.

Specific examples of the alicyclic diisocyanates include, but are not limited to, isophorone diisocyanate, cyclohexylmethane diisocyanate.

Specific examples of the aromatic diisocyanates include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

Specific examples of the aromatic aliphatic diisocyanates include, but are not limited to, α,α,α',α'-tetramethylxylylene diisocyanate.

Specific examples of the isocyanurates include, but are not limited to, tris(isocyanatoalkyl) isocyanurate and tris (isocyanatocycloalkyl) isocyanurate.

Each of these polyisocyanates can be used alone or in combination with others.

The polyester resin may be obtained by an elongation reaction between a polyester resin having an isocyanate group and water or a curing agent having an active hydrogen group. The polyester resin obtained by the elongation reaction may be simply contained in the toner. Alternatively, the polyester resin may be formed and introduced to the toner by causing an elongation reaction between the polyester resin having an isocyanate group ("reaction precursor") and water or the curing agent during the process of producing the toner.

The curing agent having an active hydrogen group is not limited to any particular material.

Specific examples of the active hydrogen group include, but are not limited to, hydroxyl groups (e.g., alcoholic hydroxyl group and phenolic hydroxyl group), amino group, carboxyl group, and mercapto group. In particular, amines are preferred as the curing agent for their reaction speed and capability of forming urea bond. Binder resins having urea bonds have excellent mechanical durability and heat-resistant storage stability. Each of these groups can be used alone or in combination with others.

Examples of the amines include, but are not limited to, diamines, amines having 3 or more valences, amino alcohols, amino mercaptans, and amino acids, and these amines in which the amino group is blocked. Each of these amines can be used alone or in combination with others. In particular, diamine alone and a mixture of a diamine and a small amount of an amine having 3 or more valences are preferable.

Specific examples of the diamine include, but are not limited to: aromatic diamines such as phenylenediamine, diethyltoluenediamine, 4,4'-diaminodiphenylmethane; alicyclic diamines such as 4,4'-diamino-3,3'-dimethyldicyclohexylmethane, diaminocyclohexane, isophoronediamine, and norbornane diamine; and aliphatic diamines such as ethylenediamine, tetramethylenediamine, and hexamethylenediamine.

Specific examples of the amines having 3 or more valences include, but are not limited to, diethylenetriamine, triethylenetetramine, and norbornane triamine.

Specific examples of the amino alcohols include, but are not limited to, ethanolamine and hydroxyethylaniline.

Specific examples of the amino mercaptans include, but are not limited to, aminoethyl mercaptan and aminopropyl mercaptan.

Specific examples of the amines in which the amino group is blocked include, but are not limited to, ketimine compounds in which the amino group is blocked with a ketone such as acetone, methyl ethyl ketone, and methyl isobutyl ketone; and oxazoline compounds.

The first polyester resin has urethane and/or urea bonds in its resin structure, which is effective for improving mechanical durability, heat-resistant storage stability, and hot offset resistance of the binder resin and toner. In particular, urea bonds are expected to exert a greater effect than urethane bond even in a small amount. If urethane and urea bonds exist in the resin structure too much, low-temperature fixability and gloss of the fixed image and charging function of the toner will deteriorate. Accordingly, the urethane group density in the binder resin is preferably from 1.5% to 15% by mass, more preferably from 2.0% to 8% by mass. The urea group density in the binder resin is preferably from 0.3% to 5% by mass, more preferably from 1.0% to 3% by mass. Urethane and urea bonds in the binder resin may be quantified by measuring the amount of elemental nitrogen (N) with a nitrogen analyzer and the ratio between urethane and urea groups with $^1$H-NMR (nuclear magnetic resonance).

The first polyester resin may be either a low-molecular-weight resin having a weight average molecular weight of less than $10^4$ when measured by gel permeation chromatography (GPC), a medium-molecular-weight resin, or a high-molecular-weight resin having a weight average molecular weight of $10^4$ or greater when measured by GPC. Preferably, the first polyester resin has a high weight average molecular weight of $10^4$ or greater for improving heat-resistant storage stability and hot offset resistance. More preferably, the first polyester resin has a weight average molecular weight of from 20,000 to 10,000,000.

Preferably, the first polyester resin contains high-molecular-weight matter that is insoluble in THF. More preferably, the first polyester resin has a cross-linked structure. The cross-linked structure may be obtained by using the above-descried alcohol or acid having 3 or more valences for producing the polyester resin. In particular, in a case in which the polyester resin has a glass transition temperature of 20° C. or less, it is preferable that the molecular weight of the polyester resin is sufficiently high for maintaining a rubber state at normal temperature and suppressing the resin from flowing.

In the present disclosure, whether or not a resin is soluble in THF is determined as follows.

First, 2 g of a resin is weighed and stirred in 100 mL of THF for 6 hours at 25° C. using a stirrer. The resulting solution is filtered with a membrane filter having an opening of 0.2 μm. The filtrate is dried at a temperature of 120° C. under a pressure of 10 kPa to separate (isolate) THF-insoluble matter. The THF-insoluble matter is weighed to calculate the rate (% by mass) of THF-insoluble matter in the resin. When the rate of THF-insoluble matter is 10% or greater, the resin is determined to be insoluble in THF. When the rate of THF-insoluble matter is less than 10%, the resin is determined to be soluble in THF.

Preferably, the first polyester resin has a glass transition temperature of from −60° C. to 70° C., determined from a DSC curve obtained in the first heating in a differential scanning calorimetric (DSC) measurement, and, at the same time, rubber elasticity at normal temperatures. Accordingly, preferably, the first polyester resin is insoluble in THF, has a glass transition temperature (Tg) of 0° C. or less, and exhibits a viscoelastic behavior of being in a rubber state at or above room temperature. In this case, the glass transition temperature is preferably in the rage of from −40° C. to 0° C. The polyester resin having a glass transition temperature within the above-specified range exerts an effect of intermolecular cohesive force of urethane and/or urea bonds and exhibits excellent rubber elasticity at normal temperatures.

The content rate of the first polyester resin in the toner is preferably from 10% to 30% by mass, more preferably from 10% to 20% by mass.

Preferably, the polyester resin further comprises a THF-soluble polyester resin ("second polyester resin"), as described above.

Preferably, the second polyester resin is an unmodified polyester resin, for improving compatibility with the polyester resin binder. Here, the unmodified polyester resin refers to a polyester resin that is obtained from a polyol and a polycarboxylic acid or a derivative thereof (e.g., a polycarboxylic acid anhydride and a polycarboxylic acid ester) and that is unmodified with isocyanate group, etc.

Examples of the polyol include, but are not limited to, diols.

Specific examples of the diols include, but are not limited to, ethylene oxide or propylene oxide adducts of bisphenol A with an average addition molar number of 1 to 10 (e.g., polyoxypropylene(2.2)-2,2-bis(4-hydroxyphenyl)propane and polyoxyethylene(2.2)-2,2-bis(4-hydroxyphenyl)propane), ethylene glycol, propylene glycol, hydrogenated bisphenol A, and ethylene oxide or propylene oxide adducts of hydrogenated bisphenol A with an average addition molar number of 1 to 10. For improving chargeability of the toner and compatibility with the first polyester resin, propylene oxide adduct of bisphenol A is preferable. Each of these diols can be used alone or in combination with others.

Examples of the polycarboxylic acid include, but are not limited to, dicarboxylic acids.

Specific examples of the dicarboxylic acids include, but are not limited to, adipic acid, phthalic acid, isophthalic acid, terephthalic acid, fumaric acid, maleic acid, and succinic acid derivatives substituted with an alkyl group having 1 to 20 carbon atoms or an alkenyl group having 2 to 20 carbon atoms, such as dodecenyl succinic acid and octyl succinic acid. Each of these dicarboxylic acids can be used alone or in combination with others.

The second polyester resin may contain at least one of a carboxylic acid having 3 or more valences and an alcohol having 3 or more valences at a terminal of the resin chain, for the purpose of adjusting acid value and/or hydroxyl group.

Specific examples of the carboxylic acid having 3 or more valences include, but are not limited to, trimellitic acid, pyromellitic acid, and anhydrides thereof.

Specific examples of the alcohol having 3 or more valences include, but are not limited to, glycerin, pentaerythritol, and trimethylolpropane.

The second polyester resin is not limited in molecular weight. However, if the molecular weight is too low, heat-resistant storage stability, chargeability, and mechanical durability (i.e., resistance to stresses, such as that caused by stirring in a developing device) of the toner will deteriorate. If the molecular weight is too high, viscoelasticity of the toner will be too high when the toner is melted, thus degrading low-temperature fixability. Thus, the weight average molecular weight (Mw), measured by GPC, is preferably from 3,000 to 30,000, more preferably from 6,000 to 14,000. The number average molecular weight (Mn) is preferably from 1,000 to 10,000, more preferably from 2,000 to 7,000. The ratio Mw/Mn is preferably from 1.0 to 4.0, more preferably from 1.0 to 3.5.

The second polyester resin preferably has an acid value of from 1 to 50 mgKOH/g, more preferably from 5 to 30 mgKOH/g. When the acid value is 1 mgKOH/g or more, the toner becomes more negatively-chargeable and more compatible with paper to improve fixability. When the acid value is in excess of 50 mgKOH/g, charge stability, particularly charge stability against environmental fluctuation, may deteriorate.

The second polyester resin preferably has a hydroxyl value of 5 mgKOH/g or more.

Preferably, the second polyester resin has a glass transition temperature of from 30° C. to 80° C., more preferably from 45° C. to 70° C., determined from a DSC curve obtained in the first heating in a differential scanning calorimetric (DSC) measurement.

The content rate of the second polyester resin in the toner is preferably from 40% to 80% by mass, more preferably from 60% to 80% by mass.

Other Binder Resin

The binder resin may further comprise a resin other than the above-described polyester resin (hereinafter the "other resin").

Specific examples of the other resin include, but are not limited to, homopolymers of styrene or substitutes thereof (e.g., polystyrene, poly(p-styrene), and polyvinyl toluene), styrene-based copolymers (e.g., styrene-p-chlorostyrene copolymer, styrene-propylene copolymer, styrene-vinyl toluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl methyl ketone copolymer, styrene-butadiene copolymer, styrene-isoprene copolymer, and styrene-maleate copolymer), polymethyl methacrylate resin, polybutyl methacrylate resin, polyvinyl chloride resin, polyvinyl acetate resin, polyethylene resin, polyurethane resin, epoxy resin, polyvinyl butyral resin, polyacrylic resin, rosin resin, modified rosin resin, terpene resin, phenol resin, aliphatic or aromatic hydrocarbon resin, aromatic petroleum resin, and the above resins modified to have a functional group reactive with an active hydrogen group. Each of these resins can be used alone or in combination with others.

Preferred examples of the other resin include resins compatible with the above polyester resin, for adjusting the glass transition temperature and storage elastic modulus of the toner to within the preferred ranges.

The binder resin may further comprise a crystalline resin in addition to the polyester resin.

Preferred examples of the crystalline resin include those meltable at around the fixing temperature. By containing such a crystalline resin in the toner, sharply-melting property of the toner is improved because the crystalline resin melts and gets dissolved in the binder resin at the fixing temperature, providing excellent low-temperature fixability.

Specific examples of the crystalline resin include, but are not limited to, polyester resin, polyurethane resin, polyurea resin, polyamide resin, polyether resin, vinyl resin, and modified crystalline resins. Each of these resins can be used alone or in combination with others.

Preferably, the crystalline resin has a melting point of from 60° C. to 100° C. When the melting point is less than 60° C., the crystalline resin becomes more likely to start melting at lower temperatures, causing deterioration of heat-resistant storage stability. When the melting point is in excess of 100° C., the crystalline resin becomes less effective for improving low-temperature fixability.

Release Agent

Specific examples of the release agent include, but are not limited to, waxes such as carbonyl-group-containing wax, polyolefin wax, and long-chain hydrocarbon wax. Each of these waxes can be used alone or in combination with others. Among these waxes, carbonyl-group-containing wax is preferable.

Specific examples of the carbonyl-group-containing wax include, but are not limited to, polyalkanoic acid ester, polyalkanol ester, polyalkanoic acid amide, polyalkyl amide, and dialkyl ketone.

Specific examples of the polyalkanoic acid ester include, but are not limited to, carnauba wax, montan wax, trimethylolpropane tribehenate, pentaerythritol tetrabehenate, pentaerythritol diacetate dibehenate, glycerin tribehenate, and 1,18-octadecanediol distearate. Specific examples of the polyalkanol ester include, but are not limited to, tristearyl trimellitate and distearyl maleate. Specific examples of the polyalkanoic acid amide include, but are not limited to, dibehenylamide. Specific examples of the polyalkyl amide include, but are not limited to, trimellitic acid tristearylamide. Specific examples of the dialkyl ketone include, but are not limited to, distearyl ketone. Among these carbonyl-group-containing waxes, polyalkanoic acid esters are preferable.

Specific examples of the polyolefin wax include, but are not limited to, polyethylene wax and propylene wax.

Specific examples of the long-chain hydrocarbon wax include, but are not limited to, paraffin wax and SASOL wax.

The release agent preferably has a melting point of from 40 to 160° C., more preferably from 50 to 120° C., and most preferably from 60 to 90° C. When the melting point is less than 40° C., heat-resistant storage stability of the toner may be adversely affected.

When the melting point is in excess of 160° C., the toner may easily cause cold offset when the toner is fixed at a low temperature.

The melting point may be determined as the temperature at which the peak of heat of fusion is observed when a sample (release agent) is heated to 200° C., thereafter cooled to 0° C. at a temperature decreasing rate of 10° C./min, and thereafter heated again at a temperature rising rate of 10° C./min, using a differential scanning calorimeter (DSC210 available from Seiko Instrument Inc.).

The release agent preferably has a melt viscosity of from 5 to 1,000 cps, more preferably from 10 to 100 cps, when measured at a temperature 20° C. higher than the melting point thereof. When the melt viscosity is less than 5 cps, releasability may deteriorate. When the melt viscosity is in excess of 1,000 cps, an effect for improving hot offset resistance and low-temperature fixability may not be obtained.

The content rate of the release agent in the toner is preferably from 1% to 20% by mass, more preferably from 3% to 15% by mass, and most preferably from 3% to 7% by mass. When the content rate is in excess of 20% by mass, fluidity of the toner may deteriorate.

Toner Properties

In accordance with some embodiments of the present invention, the toner preferably comprises the first polyester resin that is insoluble in THF. Therefore, THF-insoluble matter in the toner preferably contains the first polyester resin.

Furthermore, THF-soluble matter in the toner preferably contains the second polyester resin.

Preferably, the toner has a glass transition temperature of from 45° C. to 63° C. The glass transition temperature of the toner is adjustable by varying the ratio between the first polyester resin and the second polyester resin. When the glass transition temperature is less than 45° C., heat-resistant storage stability may deteriorate. When the glass transition temperature is in excess of 63° C., low-temperature fixability may deteriorate.

THF-insoluble matter and THF-soluble matter in the toner may be isolated by a dissolution filtration method or obtained as extraction residue by Soxhlet extraction. In the present disclosure, THF-insoluble matter and THF-soluble matter are isolated by a dissolution filtration method in the following manner.

First, 1 g of a toner is weighed and stirred in 100 mL of THF for 6 hours at 25° C. using a stirrer, thus preparing a solution of soluble matter in the toner. The solution is filtered with a membrane filter having an opening of 0.2 μm. The filtrate is stirred again in 50 mL of THF for 10 minutes using stirrer. The above operation is repeated 23 times. The filtrate is dried at a temperature of 120° C. under a pressure of 10 kPa to separate (isolate) THF-insoluble matter. The solution is also dried at a temperature of 120° C. under a pressure of 10 kPa to separate (isolate) THF-soluble matter.

In a case in which Soxhlet extraction is employed, it is preferable that THF-insoluble matter and THF-soluble matter are separated by conducting reflux for at least 6 hours using 100 parts of THF based on 1 part of the toner.

Whether or not THF-insoluble matter and THF-soluble matter contain the first polyester resin and the second polyester resin, respectively, can be confirmed by a known analysis method for identifying the resin structure, such as NMR (e.g., $^{1}$H-NMR and $^{13}$C-NMR), mass spectrometry (e.g., pyrolysis gas chromatography (pyrolysis GC/MS)), and infrared spectroscopy (IR).

Glass transition temperatures of the toner, THF-insoluble matter in the toner, and resins can be measured with a differential scanning calorimeter (DSC) (Q-200 available from TA Instruments) as follows.

First, about 5.0 mg of a sample is put in an aluminum sample container. The sample container is put on a holder unit and set in an electric furnace. As a reference, 10 mg of alumina is put in an aluminum sample container in the same manner as the sample. The sample container is heated from −80° C. to 150° C. at a temperature rising rate of 10° C./min ("first heating process") in nitrogen atmosphere. The sample container is thereafter cooled from 150° C. to −80° C. at a temperature falling rate of 10° C./min ("cooling process") and heated to 150° C. again at a temperature rising rate of 10° C./min ("second heating process"). During these processes, a change in the amount of heat absorption/generation is measured. A DSC curve is obtained by drawing a graph showing a relation between temperature and the amount of heat absorption/generation. The obtained DSC curves are analyzed with an analysis program installed in Q-200. The glass transition temperature of the sample is determined by selecting the DSC curve obtained in the first heating process and determining the intersection of an extended line of the base line of the DSC curve at a temperature lower than the temperature at which enthalpy relaxation of the amount of heat absorption occurs, and a tangent line of the DSC curve indicating the maximum inclination at the enthalpy relaxation. In a case in which the sample has a melting point, the peak top temperature at which the amount of heat absorption becomes maximum in the DSC curve obtained in the first heating process is determined as the melting point.

Storage elastic modulus (G') and tan δ of the toner can be measured with a dynamic viscoelasticity measuring instrument (ARES available from TA Instruments) as follows. First, a sample is pressure-molded into a pellet having a diameter of 8 mm and a thickness of from 0.9 to 1.2 mm by applying a sufficient pressure so as not to generate void in the pellet. The resulting pellet is fixed in the measuring instrument with parallel plates having a diameter of 8 mm. The pellet is brought into intimate contact with the parallel plates at a temperature equal to or higher than the glass transition temperature of the sample and stabilized at 30° C., followed by starting of a measurement. In the measurement, the frequency is set to 1 Hz (6.28 rad/s), the amount of strain is set to 0.1% (strain control mode), and the temperature is raised from 30° C. to 200° C. at a temperature rising rate of 2.0° C./min. tan δ for each temperature is determined from the ratio of the loss elastic modulus to the storage elastic modulus for each temperature.

Preferably, the toner has a weight average particle diameter (Dv) of from 3 to 10 μm, more preferably from 4 to 7 μm, for obtaining images having excellent granularity, sharpness, and thin-line reproducibility. When the weight average particle diameter is less than 3 μm, although sharpness and thin-line reproducibility of the image are excellent, fluidity and transferability of the toner may deteriorate. The ratio (Dv/Dn) of the weight average particle diameter (Dv) to the number average molecular weight (Dn) indicates a particle size distribution of the toner. The closer the ratio to 1, the sharper the particle size distribution. Preferably, Dv/Dn is 1.20 or less, more preferably 1.15 or less, for sharpness and thin-line reproducibility.

The weight average particle diameter (Dv) and number average molecular weight (Dn) of the toner can be measured under the following conditions.

Measuring instrument: COULTER MULTISIZER III (product of Beckman Coulter, Inc.)

Aperture diameter: 100 μm

Analysis software: BECKMAN COULTER MULTISIZER 3 VERSION 3.51 (product of Beckman Coulter, Inc.)

Electrolyte liquid: ISOTON III (product of Beckman Coulter, Inc.)

Dispersion liquid: 10% by mass solution of a surfactant (i.e., alkylbenzene sulfonate, NEOGEN SC-A product of DKS Co., Ltd.)

Dispersing condition: First, 10 mg of a sample is dispersed in 5 mL of the dispersion liquid by an ultrasonic disperser for 1 minute. After adding 25 mL of the electrolyte liquid to the dispersion liquid, the sample is further dispersed therein by the ultrasonic disperser for 1 minute.

Measuring condition: In a beaker, 100 mL of the electrolyte liquid and the dispersion liquid are contained. The concentration of toner particles is adjusted such that 30,000 toner particles can be subjected to a measurement of particle diameter over a period of 20 seconds.

The weight average particle diameter is determined from the measured particle size distribution of 30,000 toner particles.

Toner Constituents

The toner may further contain constituents such as a charge controlling agent, an external additive, a fluidity improving agent, and a cleanability improving agent, other than the polyester resin, the release agent, and the colorant.

The color of the colorant is not particularly limited and may have a color such as magenta, cyan, and yellow. Two or more colorants can be used in combination.

Specific examples of usable magenta colorants include, but are not limited to, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, and 211; C.I. Pigment Violet 19; and C.I. Vat Red 1, 2, 10, 13, 15, 23, 29, and 35.

Specific examples of usable cyan colorants include, but are not limited to, C.I. Pigment Blue 2, 3, 15, 15:1, 15:2, 15:3, 15:4, 15:6, 16, 17, and 60; C.I. Vat Blue 6; C.I. Acid Blue 45; copper phthalocyanine pigments having a phthalocyanine skeleton substituted with 1 to 5 phthalimidemethyl groups; and Green 7 and Green 35.

Specific examples of usable yellow colorants include, but are not limited to, C.I. Pigment Yellow 0-16, 1, 2, 3, 4, 5, 6, 7, 10, 11, 12, 13, 14, 15, 16, 17, 23, 55, 65, 73, 74, 83, 97, 110, 151, 154, 180, and 185; C.I. Vat Yellow 1, 3, and 20; and Orange 36.

The content rate of the colorant in the toner is preferably from 1% to 15% by mass, more preferably from 3% to 10% by mass. When the content rate is less than 1% by mass, coloring power of the toner may deteriorate. When the content rate is in excess of 15% by mass, the colorant cannot be uniformly dispersed in the toner, thereby degrading coloring power and electric property of the toner.

The colorant may be combined with a resin to be used as a master batch. Specific examples of usable resins for the master batch include, but are not limited to, polymers of styrene or substitutes thereof, styrene-based copolymers, polymethyl methacrylate resin, polybutyl methacrylate resin, polyvinyl chloride resin, polyvinyl acetate resin, polyethylene resin, polypropylene resin, polyester resin, epoxy resin, epoxy polyol resin, polyurethane resin, polyamide resin, polyvinyl butyral resin, polyacrylic resin, rosin, modified rosin, terpene resin, aliphatic hydrocarbon resin, alicyclic hydrocarbon resin, aromatic petroleum resin, chlorinated paraffin, and paraffin. Each of these resins can be used alone or in combination with others.

Specific examples of the polymers of styrene or substitutes thereof include, but are not limited to, polyester resin, polystyrene resin, poly-p-chlorostyrene resin, and polyvinyl toluene resin. Specific examples of the styrene-based copolymers include, but are not limited to, styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

The master batch can be obtained by mixing and kneading the resin and the colorant while applying a high shearing force thereto. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

There is a concern that a colored material may change the color tone of the toner. Therefore, colorless or whitish materials are preferably used for the charge controlling agent. Specific examples of such colorless or whitish charge controlling agents include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Each of these materials can be used alone or in combination with others.

Specific examples of commercially available charge controlling agents include, but are not limited to: BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product) manufactured by Orient Chemical Industries Co., Ltd.; TP-302 and TP-415 (both molybdenum complexes of quaternary ammonium salts) manufactured by Hodogaya Chemical Co., Ltd.; COPY CHARGE® PSY VP2038 (quaternary ammonium salt), COPY BLUE® PR (triphenyl methane derivative), and COPY CHARGE® NEG VP2036 and COPY CHARGE® NX VP434 (both quaternary ammonium salts) manufactured by Hoechst AG; LRA-901 and LR-147 (boron complex) manufactured by Japan Carlit Co., Ltd.; quinacridone; azo pigments, and polymers having a functional group such as sulfonate group, carboxyl group, and quaternary ammonium salt.

The charge controlling agent may be melt-kneaded with the master batch and thereafter dissolved or dispersed in an organic solvent. Of course, the charge control agent may be directly dissolved or dispersed in an organic solvent along with other toner constituents. Alternatively, the charge controlling agent may be fixed on the surface of the resulting toner particles.

The content of the charge controlling agent in the toner is determined depending on the type of the binder resin, presence or absence of additives, and/or dispersing method, and is not particularly limited. In accordance with some embodiments, the content of the charge control agent is preferably 10 parts by mass or less, more preferably 5 parts by mass or less, based on 100 parts by mass of the binder resin. When the content is in excess of 10 parts by mass, chargeability of the toner becomes so large that the main effect of the charge control agent is reduced. As a result, the electrostatic force between the toner and a developing roller is increased and fluidity of the developer and image density are lowered.

Specific examples of the external additive include, but are not limited to, fine particle silica, fine particle hydrophobized silica, metal salts of fatty acids (e.g., zinc stearate and aluminum stearate), metal oxides (e.g., titanium oxide, alumina, tin oxide, and antimony oxide), and fine particle hydrophobized metal oxide, and fluoropolymers. Among these, fine particle hydrophobized silica, fine particle hydrophobized titanium oxide, and fine particle hydrophobized alumina are preferable.

Specific examples of commercially-available fine particle silica include, but are not limited to: HDK H 2000, HDK H 2000/4, HDK H 2050EP, HVK 21, and HDK H 1303 (available from Hoechst AG); and R972, R974, RX200, RY200, R202, R805, and R812 available from Nippon Aerosil Co., Ltd.). Specific examples of commercially-available fine particle titanium oxide include, but are not limited to: P-25 (available from Nippon Aerosil Co., Ltd.); STT-30 and STT-65C-S (available from Titan Kogyo, Ltd.); TAF-140 (available from Fuji Titanium Industry Co., Ltd.); and MT-150W, MT-500B, MT-600B, and MT-150A (available from TAYCA Corporation). Specific examples of commercially-available fine particle hydrophobized titanium oxide include, but are not limited to: T-805 (available from Nippon Aerosil Co., Ltd.); STT-30A and STT-65S-S (available from Titan Kogyo, Ltd.); TAF-500T and TAF-1500T (available from Fuji Titanium Industry Co., Ltd.); MT-100S and MT-100T (available from TAYCA Corporation); and IT-S (available from Ishihara Sangyo Kaisha, Ltd.).

The hydrophobized fine particles of silica, titanium oxide, and alumina can be obtained by treating fine particles silica, titania, and alumina, respectively, which are hydrophilic, with a silane coupling agent such as methyltrimethoxysilane, methyltriethoxysilane, and octyltrimethoxysilane.

In addition, silicone-oil-treated inorganic fine particles treated with a silicone oil, optionally with application of heat, are also preferable.

Specific examples of the silicone oil include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl-modified or methacryl-modified silicone oil, and α-methylstyrene-modified silicone oil.

Specific examples of the inorganic particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable.

Preferably, the content rate of the external additive in the toner is from 0.1% to 5% by mass, more preferably from 0.3% to 3% by mass.

Preferably, primary particles of the inorganic fine particle have a number average particle diameter of 100 nm or less, more preferably from 3 to 70 nm. When the number average particle diameter is less than 3 nm, the inorganic fine particle may be embedded in the toner and the function thereof cannot be effectively exhibited. When the number average particle diameter is in excess of 70 nm, the surface of an electrostatic latent image bearer may be non-uniformly damaged.

The external additive may comprise the above inorganic fine particle and hydrophobized inorganic fine particle in combination. Preferably, the external additive comprises two types of hydrophobized inorganic fine particles, the primary particles of each of which having a number average particle diameter of from 1 to 100 nm, more preferably from 5 to 70 nm. More preferably, the external additive comprises at least two types of hydrophobized inorganic fine particles, the primary particles of each of which having a number average particle diameter of 20 nm or less, and at least one type of inorganic fine particle, the primary particles of which having a number average particle diameter of 30 nm or more. Preferably, the BET specific surface area of the external additive is from 20 to 500 $m^2/g$.

Specific examples of surface treatment agents for the external additive (including fine particle oxides) include, but are not limited to: silane coupling agents such as dialkyl dihalogenated silane, trialkyl halogenated silane, alkyl trihalogenated silane, and hexaalkyl disilazane; silylation agents; silane coupling agents having a fluorinated alkyl group; organic titanate coupling agents; aluminum coupling agents; silicone oils; and silicone varnishes.

The external additive may further comprise a fine particle resin. Specific examples of the fine particle resin include, but are not limited to, polystyrene particles obtained by soap-free emulsion polymerization, suspension polymerization, or dispersion polymerization; particles of copolymer of methacrylates and/or acrylates; polycondensation polymer particles (e.g., silicone, benzoguanamine, and nylon); and thermosetting resin particles. By using such a fine particle resin in combination, chargeability of the toner is enhanced, the amount of reversely-charged toner particles is reduced, and the degree of background fouling is reduced. The content rate of the fine particle resin in the toner is preferably from 0.01% to 5% by mass, more preferably from 0.1% to 2% by mass.

The fluidity improving agent refers to a toner surface treatment agent that improves hydrophobicity of the toner to prevent deterioration of fluidity and chargeability of the toner even under high-humidity environments. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils.

The cleanability improving agent is an additive that facilitates easy removal of the toner remaining on an electrostatic latent image bearer or intermediate transferor after image transfer. Specific examples of the cleanability improving agent include, but are not limited to, metal salts of fatty acids (e.g., zinc stearate and calcium stearate) and fine particles of polymers prepared by soap-free emulsion polymerization (e.g., polymethyl methacrylate and polystyrene). Preferably, the particle size distribution of the fine particles of polymers is as narrow as possible. More preferably, the volume average particle diameter thereof is in the range of from 0.01 to 1 μm.

Toner Production Method

The toner in accordance with some embodiments of the present invention in not limited in production method and material. For example, the toner may be produced by a kneading pulverization method, or a chemical method that granulates toner particles in an aqueous medium. In particular, in the chemical method, raw materials can be uniformly dispersed in the toner as the reaction precursor is allowed to elongate and react with water or the curing agent during the toner production process to form the polyester resin in the toner.

Specific examples of the chemical method that granulate toner particles in an aqueous medium include, but are not limited to: suspension polymerization, emulsion polymerization, seed polymerization, and dispersion polymerization methods, each of which uses a monomer as a starting material; a dissolution suspension method in which a resin or resin precursor is dissolved in an organic solvent and then dispersed or emulsified in an aqueous medium; a phase-inversion emulsification method in which a solution comprising a resin or resin precursor and an appropriate emulsifier is phase-inverted by addition of water; and an aggregation method in which resin particles obtained by the above methods remaining dispersed in an aqueous medium are aggregated and granulated into particles having a desired size by heat melting or the like.

Preferably, mother toner particles are granulated by dispersing or emulsifying a toner composition comprising the binder resin in an aqueous medium. In particular, it is preferable that a polyester resin having high rubber elasticity is uniformly blended in the toner. Therefore, more preferably, mother toner particles are granulated by dispersing or emulsifying an oil phase, in which a toner composition comprising the binder resin and the reactive precursor are dissolved or dispersed in an organic solvent, in an aqueous medium.

In the process of emulsifying or dispersing the oil phase in an aqueous medium, a surfactant or a polymeric protection colloid may be used.

Specific examples of the surfactant include, but are not limited to, anionic surfactants such as alkylbenzene sulfonate, α-olefin sulfonate, and phosphates; cationic surfactants such as amine salt type surfactants (e.g., alkylamine salts, amino alcohol fatty acid derivatives, polyamine fatty acid derivatives, and imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi (aminoethyl) glycine, di(octylaminoethyl) glycine, and N-alkyl-N,N-dimethyl ammonium betaine.

Surfactants having a fluoroalkyl group can achieve their effect in a very small amount. Examples of the surfactants having a fluoroalkyl group include, but are not limited to, anionic surfactants having a fluoroalkyl group and cationic surfactants having a fluoroalkyl group.

Specific examples of the anionic surfactants having a fluoroalkyl group include, but are not limited to, fluoroalkyl carboxylic acids having 2 to 10 carbon atoms and metal salts thereof, disodium perfluorooctanesulfonyl glutamate, sodium 3-[ω-fluoroalkyl(C6-C11)oxy]-1-alkyl(C3-C4) sulfonate, sodium 3-[ω-fluoroalkanoyl(C6-C8)-N-ethylamino]-1-propane sulfonate, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl (C6-C10)-N-ethyl sulfonyl glycine salts, and monoperfluoroalkyl(C6-C16) ethyl phosphates.

Specific examples of the cationic surfactants having a fluoroalkyl group include, but are not limited to, aliphatic primary or secondary amine acids having a fluoroalkyl group, aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts.

Specific examples of the polymeric protection colloid include, but are not limited to, homopolymers and copolymers of monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide), vinyl alcohols, vinyl alcohol ethers (e.g., vinyl methyl ether, vinyl ethyl ether, and vinyl propyl ether), esters of vinyl alcohols with carboxyl-group-containing compounds (e.g., vinyl acetate, vinyl propionate, and vinyl butyrate), amides (e.g., acrylamide, methacrylamide, and diacetone acrylamide) and methylol compounds thereof, acid chlorides (e.g., acrylic acid chloride and methacrylic acid chloride), and compounds containing nitrogen or a nitrogen-containing heterocyclic ring (e.g., vinyl pyridine, vinyl pyrrolidone, vinyl imidazole, and ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, and polyoxyethylene nonyl phenyl ester); and celluloses (e.g., methyl cellulose, hydroxyethyl cellulose, and hydroxypropyl cellulose).

Specific examples of the organic solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these solvents can be used alone or in combination with others. Among these solvents, ester solvents such as methyl acetate and ethyl acetate, aromatic solvents such as toluene and xylene, and halogenated hydrocarbons such as 1,2-dichloroethane, chloroform, and carbon tetrachloride are preferable.

The oil phase, obtained by dissolving or dispersing the toner composition in the organic solvent, preferably has a solid content concentration of from 40% to 80% by mass. When the concentration is too high, it becomes difficult to dissolve or disperse the toner composition in the organic solvent, and the viscosity of the oil phase becomes too high to easily handle. When the concentration is too low, the toner production amount is reduced.

The aqueous medium may comprise water alone or a combination of water with a water-miscible solvent. Specific examples of the water-miscible solvent include, but are not limited to, alcohols (e.g., methanol, isopropanol, and ethylene glycol), dimethylformamide, tetrahydrofuran, cellosolves (e.g., methyl cellosolve), and lower ketones (e.g., acetone and methyl ethyl ketone).

Preferably, the amount of use of the aqueous medium is from 50 to 2,000 parts by mass, more preferably from 100 to 1,000 parts by mass, based on 100 parts by mass of the toner composition. When the amount of use is less than 50 parts by mass, dispersion state of the toner composition is so poor that toner particles having a desired particle size cannot be obtained. When the amount of use is in excess of 2,000 parts by mass, it is not economical.

In the aqueous medium, an inorganic dispersant and/or fine particle organic resin may be previously dispersed for narrowing the particle size distribution and improving dispersion stability of resulting toner particles.

Specific examples of the inorganic dispersant include, but are not limited to, tricalcium phosphate, calcium carbonate, titanium oxide, colloidal silica, and hydroxyapatite.

Specific examples of the organic resin include, but are not limited to, thermoplastic and thermosetting resins capable of forming an aqueous dispersion thereof, such as vinyl resin, polyurethane resin, epoxy resin, polyester resin, polyamide resin, polyimide resin, silicon resin, phenol resin, melamine resin, urea resin, aniline resin, ionomer resin, and polycarbonate resin. Each of these resins can be used alone or in combination with others.

The oil phase may be emulsified or dispersed in the aqueous medium by any known dispersing equipment such as a low-speed shearing disperser, high-speed shearing disperser, frictional disperser, high-pressure jet disperser, and ultrasonic disperser. For reducing the particle size of resulting particles, a high-speed shearing disperser is preferable. When a high-speed shearing disperser is used, the revolution is typically from 1,000 to 30,000 rpm and preferably from 5,000 to 20,000 rpm. The dispersing temperature is typically from 0° C. to 150° C. (under pressure) and preferably from 20° C. to 80° C.

In a case in which the toner composition contains the reactive precursor, the compound having an active hydrogen group, with which the reactive precursor elongates or cross-links, may be previously mixed in the oil phase before the oil phase is dispersed in the aqueous medium. Alternatively, the compound having an active hydrogen group may be mixed in the aqueous medium.

The organic solvent may be removed from the resulting emulsion or dispersion by gradually heating the whole system under normal or reduced pressure to completely evaporate the organic solvent contained in liquid droplets.

In the aggregation method, the above-prepared fine particle resin dispersion liquid, optionally along with a colorant dispersion liquid, a release agent liquid, etc., is aggregated to granulate particles. The fine particle resin dispersion liquid may comprise either one type of fine particle resin dispersion liquid or two or more types of fine particle resin dispersion liquids. The fine particle resin dispersion liquid may be added either at once or several times in a separate manner. The same applies to the other dispersion liquids.

As means for controlling the aggregation state, application of heat, addition of a metal salt, or adjustment of pH is preferably employed.

Specific examples of the metal in the metal salt include, but are not limited to, monovalent metals such as sodium and potassium, divalent metals such as calcium and magnesium, and trivalent metals such as aluminum.

Specific examples of the anionic ion in the metal salt include, but are not limited to, chloride ion, bromide ion, iodide ion, carbonate ion, and sulfate ion. Specific preferred examples of the metal salts include, but are not limited to, magnesium chloride, aluminum chloride, and composite bodies or multimers thereof.

By being heated during or after completion of the aggregation process, the fine resin particles are fused to each other in an accelerated manner, which is preferable for homogeneity of the toner. The shape of toner can be controlled by application of heat. Generally, the greater the amount of applied heat, the more spherical the shape of toner.

Mother toner particles dispersed in the aqueous medium are washed and dried by known methods as follows.

First, the dispersion is solid-liquid separated by a centrifugal separator or filter press. The resulting toner cake is re-dispersed in ion-exchange water having a temperature ranging from normal temperature to about 40° C. After optionally adjusting pH by acids and bases, the dispersion is subjected to solid-liquid separation again. These processes are repeated several times to remove impurities and surfactants. The resulting toner cake is then dried by an airflow dryer, circulation dryer, reduced-pressure dryer, or vibration fluidized dryer, thus obtaining toner particles. Undesired ultrafine particles may be removed by a centrifugal separator during the drying process. Alternatively, the particle size distribution may be adjusted by a classifier after the drying process.

Developer

The developer in accordance with some embodiments of the present invention comprises at least the above-described toner and optionally other components such as a carrier.

The developer may be either a one-component developer or a two-component developer. When the developer is used for a high-speed printer that is compatible with recent improvement in information processing speed, it is preferable that the developer is a two-component developer for extending the lifespan.

In the case of one-component developer, even when toner supply to the developer and toner consumption for developing image are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, good and stable developability and image can be obtained.

In the case of two-component developer, even when toner supply and toner consumption are repeatedly performed for a long period of time, the particle diameter of the toner fluctuates very little. Thus, even when the developer is stirred in a developing device for a long period of time, good and stable developability can be obtained.

Carrier

Preferably, the carrier comprises a core material and a resin layer covering the core material.

Specific examples of the core material include, but are not limited to, manganese-strontium (Mn—Sr) and manganese-magnesium (Mn—Mg) materials having a magnetization of from 50 to 90 emu/g. For securing image density, high magnetization materials such as iron powders having a magnetization of 100 emu/g or more and magnetites having a magnetization of from 75 to 120 emu/g are preferable. Additionally, low magnetization materials such as copper-zinc (Cu—Zn) materials having a magnetization of from 30 to 80 emu/g are preferable for improving image quality, because such materials are capable of reducing the impact of the magnetic brush to an electrostatic latent image bearer. Each of these materials can be used alone or in combination with others.

The core material preferably has a weight average particle diameter (D50) of from 10 to 200 μm, more preferably from 40 to 100 μm. When the weight average particle diameter (D50) is less than 10 μm, the amount of ultrafine particles in the carrier particles may increase, the magnetization per particle may decrease, and carrier scattering may occur. When the weight average particle diameter (D50) is in excess of 200 μm, the specific surface area may decrease, toner scattering may occur, and solid-portion reproducibility may decrease in full-color images.

Specific usable materials for the resin layer include, but are not limited to, amino resin, polyvinyl resin, polystyrene resin, halogenated olefin resin, polyester resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer copolymer, copolymer of vinylidene fluoride and vinyl fluoride copolymer, fluoroterpolymer of tetrafluoroethylene, vinylidene fluoride, and non-fluoride monomer, silicone resin, melamine resin, guanamine resin, and condensation products of melamine and/or guanamine resin with an acrylic resin having hydroxyl group. Each of these materials can be used alone or in combination with others. Among these materials, condensation products of melamine and/or guanamine resin with an acrylic resin having hydroxyl group are most preferable.

Specific examples of the melamine resin include, but are not limited to, formaldehyde adducts and addition condensates of melamine (i.e., 1,3,5-triazine-2,4,6-triamine), and alkoxyalkylated products of these compounds.

Specific examples of the alkoxyalkylated melamine resin include, but are not limited to, melamine resins substituted with at least one alkoxyalkyl group such as methoxymethyl group, ethoxymethyl group, ethoxyethyl group, propoxymethyl group, propoxyethyl group, and butoxymethyl group.

Specific examples of the guanamine resin include, but are not limited to, formaldehyde adducts and addition condensates of guanamine (i.e., 1,3,5-triazine-2,4-diamine), benzoguanamine, and alkyl guanamine, and N-alkoxyalkylated products of these compounds.

Specific examples of the N-alkoxyalkylated guanamine resin include, but are not limited to, guanamine, alkyl guanamine, and benzoguanamine resins substituted with at least one alkoxyalkyl group such as methoxymethyl group, ethoxymethyl group, ethoxyethyl group, propoxymethyl group, propoxyethyl group, and butoxymethyl group. Among these, N-alkoxyalkylated benzoguanamine resin is preferable for its excellent toughness.

Preferably, the degree of polymerization of the melamine and guanamine resin is 2 or less. When the degree of polymerization is 3 or more, self-condensation is caused or a cluster structure is formed, and the resin becomes brittle. In particular, tetrabutoxymethylated benzoguanamine is preferable, that is excellent in durability, resistance to carrier contamination with layered inorganic minerals, and environmental stability of charge.

The acrylic resin having hydroxyl group has good reactivity with the melamine and guanamine resins and forms a cross-linked structure having both flexibility and high hardness therewith.

Specific examples of the acrylic resin include, but are not limited to: ε-caprolactone adducts of hydroxyethyl acrylate and methacrylate, hydroxypropyl acrylate and methacrylate, hydroxybutyl acrylate and methacrylate, 1,4-butanediol monoacrylate and monomethacrylate, and hydroxyethyl acrylate and methacrylate; and ethylene or propylene adducts of hydroxyethyl acrylate and methacrylate. Specific examples of other copolymerizable monomers include, but are not limited to, acrylic or methacrylic acid esters, such as methyl acrylate and methacrylate, ethyl acrylate and methacrylate, propyl acrylate and methacrylate, n-butyl acrylate and methacrylate, isobutyl acrylate and methacrylate, tert-butyl acrylate and methacrylate, 2-ethylhexyl acrylate and methacrylate, stearyl acrylate and methacrylate, tridecyl acrylate and methacrylate, cyclohexyl acrylate and methacrylate, phenyl acrylate and methacrylate, and dimethylaminoethyl acrylate and methacrylate, styrene, α-methylstyrene, vinyl toluene, acrylonitrile, vinyl acetate, vinyl propionate, acrylamide and methacrylamide, methylol acrylamide, vinyl chloride, propylene, and ethylene.

The resin layer may contain a fine particle inorganic oxide for improving film strength. Specific examples of the fine particle inorganic oxide include, but are not limited to, silica, alumina, titanium oxide, iron oxide, copper oxide, zinc oxide, tin oxide, chromium oxide, cerium oxide, magnesium oxide, and zirconium oxide. Each of these materials can be used alone or in combination with others. Among these materials, silica, alumina, and titanium dioxide are preferable, and alumina is most preferable. Alumina not only improves film strength but also exhibits excellent retentivity of charge generated on the carrier due to its high resistance value. The fine particle inorganic oxide may be subjected to a surface treatment such as hydrophobizing treatment.

The content rate of the fine particle inorganic oxide in the resin layer is preferably from 2% to 40% by mass, more preferably from 5% to 20% by mass.

The resin layer may further contain a conductive powder such as a metal powder, carbon black, titanium oxide, tin oxide, and zinc oxide. Among these materials, carbon black is preferable. Preferably, the conductive powder has an average particle diameter of 1 μm or less. When the average particle diameter is greater than 1 μm, it may be difficult to control electric resistivity.

The resin layer may be formed as follows. First, a melamine or guanamine resin is dissolved in a nonaqueous medium while optionally being heated. The fine particle inorganic oxide is mixed in the resulting solution and uniformly dispersed therein with a disperser such as homogenizer. The resulting dispersion liquid is mixed in a nonaqueous medium solution of an acrylic resin and stirred with the homogenizer. Further, a charge controlling agent, a resistivity controlling agent, etc., are optionally mixed therein. The core material is uniformly coated with the resulting coating liquid by any known coating method, followed by drying and baking. The coating method may be, for example, dipping, spraying, or brush coating.

Specific examples of the nonaqueous medium include, but are not limited to, toluene, xylene, methyl ethyl ketone, methyl isobutyl ketone, cellosolve, and butyl acetate.

The baking method may be either an external heating method or an internal heating method, and for example, a stationary electric furnace, fluid electric furnace, rotary electric furnace, burner furnace, or microwave may be used.

Preferably, the content rate of the carrier in the resin layer is from 0.01% to 5.0% by mass. When the content rate is less than 0.01% by mass, it may be impossible to form a uniform resin layer on the surface of the core material. When the content rate is in excess of 5.0% by mass, the resin layer becomes so thick that coalescence of carrier particles occurs and uniform carrier particles may not be obtained.

In the case of two-component developer, the content rate of the carrier in the two-component developer is preferably from 90% to 98% by mass, more preferably from 93% to 97% by mass.

Image Forming Apparatus

The image forming apparatus in accordance with some embodiments of the present invention includes at least an electrostatic latent image bearing member, a charger, an irradiator, a developing device, a transfer device, and a fixing device, and optionally other devices such as a cleaner, a neutralizer, a recycler, and a controller.

The developing device is configured to develop an electrostatic latent image into a toner image with the toner in accordance with some embodiments of the present invention.

The charger and irradiator may be collectively referred to as an "electrostatic latent image forming device". The developing device comprises a magnetic field generator fixed inside and a developer bearer that is rotatable while carrying the toner.

Electrostatic Latent Image Bearer

The electrostatic latent image bearer is not limited in material, shape, structure, and size. The shape thereof may be, for example, drum-like, sheet-like, or endless-belt-like. The structure may be either single-layer or multi-layer. The size can be determined depending on the size and specification of the image forming apparatus. The material may comprise an inorganic photoreceptor such as amorphous silicon, selenium, CdS, and ZnO, or an organic photoconductor (OPC) such as polysilane and phthalopolymethine.

Charger

The charger is configured to charge the surface of the electrostatic latent image bearer.

The charger has no particular limit so long as being capable of uniformly charging the surface of the electrostatic latent image bearer by applying a voltage thereto. The charger may be of either contact charger (1) or non-contact charger (2).

Specific examples of the contact charger (1) include, but are not limited to, conductive or semiconductive charging roller, magnetic brush, fur brush, film, and rubber blade. In particular, charging rollers can drastically reduce the amount of ozone generation than that of corona discharge, exhibit excellent stability in repeated use, and effectively prevent image deterioration.

Specific examples of the non-contact charger (2) include, but are not limited to, those utilizing corona discharge, multi-stylus electrode, solid discharge element, and conductive or semiconductive charging roller disposed forming a microgap with the electrostatic latent image bearer.

Irradiator

The irradiator is configured to irradiate the charged surface of the electrostatic latent image bearer with light to form an electrostatic latent image.

The irradiator has no particular limit so long as being capable of irradiating the surface of the electrostatic latent image bearer having charged by the charger with light containing image information. Specific examples of the irradiator include, but are not limited to, various irradiators based on radiation optical system, rod lens array system, laser optical system, liquid crystal shutter optical system, and LED optical system. The irradiation of light may be performed from the reverse surface (back surface) side of the electrostatic latent image bearing member.

Developing Device

The developing device is configured to develop an electrostatic latent image into a toner image with the toner in accordance with some embodiments of the present invention.

The developing device has no particular limit so long as being capable of developing latent images with the toner. Preferably, the developing device is configured to store the toner and supply the toner to the electrostatic latent image in a contact or non-contact manner.

The developing device may employ either a dry developing method or a wet developing method. The developing device may be either a single-color developing device or a multi-color developing device. Preferably, the developing device includes a stirrer for frictionally stirring and charging the toner, a magnetic field generator fixed inside the developing device, and a developer bearer that is rotatable while carrying the developer on its surface.

In the developing device, the toner particles and carrier particles are mixed and stirred so that the toner particles are frictionally charged. The charged toner particles and carrier particles are held on the surface of a magnet roller forming chain-like aggregations (hereinafter "magnetic brush"). The magnet roller is disposed adjacent to the electrostatic latent image bearing member. Therefore, a part of the toner particles in the magnetic brush migrates from the surface of the magnet roller to the surface of the electrostatic latent image bearing member by an electric attractive force. As a result, the electrostatic latent image is developed with the toner and formed into a toner image on the surface of the electrostatic latent image bearer.

FIG. 1 is a schematic view of a two-component developing device in accordance with some embodiments of the present invention, using a two-component developer comprising the above toner and a magnetic carrier. In a two-component developing device 424, a two component developer is stirred and conveyed by a screw 441 and supplied to a developing sleeve 442 serving as a developer bearer. The two component developer supplied to the developing sleeve 442 is regulated by a doctor blade 443 serving as a layer thickness regulator. The developer supply amount is controlled by a doctor gap formed between the doctor blade 443 and the developing sleeve 442. When the distance of the doctor gap is too small, the developer supply amount is too small to obtain a sufficient image density. When the distance of the doctor gap is too large, the developer supply amount is excessively large and carrier deposition occurs on a photoconductor drum 1 serving as an electrostatic latent image bearer. Inside the developing sleeve 442, a magnet is disposed. The magnet serves as a magnetic field generator that generates a magnetic field that forms the developer into a magnetic brush on the peripheral surface of the developing sleeve 442. Specifically, the developer is formed into a chain-like magnetic brush on the developing sleeve 442 along the lines of magnetic force in a normal line direction generated by the magnet.

The developing sleeve 442 and the photoconductor drum 1 are disposed adjacent to each other forming a developing gap therebetween. A developing region is formed within a portion where the developing sleeve 442 and the photoconductor drum 1 face each other. The developing sleeve 442 is formed of a cylinder made of a non-magnetic body such as aluminum, brass, stainless steel, and a conductive resin, and is rotatable by a rotary driver. The magnetic brush is transferred to the developing region as the developing sleeve 442 rotates. As a developing power source applies a developing voltage to the developing sleeve 442, the toner particles on the magnetic brush are separated from the carrier particles by the action of a developing electric field formed between the developing sleeve 442 and the photoconductor drum 1 and develop an electrostatic latent image on the photoconductor drum 1. An alternating current may be superimposed on the developing voltage.

Preferably, the distance of the developing gap is from 5 to 30 times the particle diameter of the developer. When the particle diameter of the developer is 50 μm, the distance of the developing gap is preferably set to within 0.25 to 1.5 mm. When the distance of the developing gap is greater than the above specified range, it may be difficult to obtain a desired image density.

Preferably, the distance of the doctor gap is equal to or slightly greater than that of the developing gap. The drum diameter and drum linear velocity of the photoconductor drum 1 and the sleeve diameter and sleeve linear velocity of the developing sleeve 442 are determined depending on the copying speed, size of the apparatus, etc. Preferably, the ratio of the sleeve linear velocity to the drum linear velocity is 1.1 or greater, for obtaining a required image density. It is also possible to dispose a sensor downstream from the developing region to detect the toner deposition amount from optical reflectance and to control the process conditions.

Transfer Device

The transfer device is configured to transfer the toner image onto a recording medium.

The transfer device may be either a direct transfer device or a secondary transfer device. The direct transfer device is configured to directly transfer a toner image from an electrostatic latent image bearer onto a recording medium. The secondary transfer device is configured to primarily transfer a toner image onto an intermediate transferor and secondarily transfer the toner image onto a recording medium.

Fixing Device

The fixing device is configured to fix the transferred toner image on the recording medium.

Preferably, the fixing device comprises a fixing member and a heater for heating the fixing member. The fixing member has no particular limit so long as being capable of forming a nip portion by contacting other and capable of pressurizing the transferred toner image on the recording medium. The fixing member may comprise, for example, a combination of an endless belt and a roller or another combination of two rollers. For shortening warm-up time for energy saving, preferably, the fixing member comprises the combination of an endless belt and a roller, or the fixing member is heated from its surface by means of induction heating.

The fixing device may employ either an internal heating method (1) or an external heating method (2). In the case of internal heating method (1), the fixing member comprises at least one of a roller and a belt and is heated from a side which is not in contact with toner, and a toner image is fixed on a recording medium by application of heat and pressure. In the case of external heating method (2), the fixing member comprises at least one of a roller and a belt and is heated from a side which is in contact with toner, and a toner image is fixed on a recording medium by application of heat and pressure. The fixing device may also employ a method in which the internal heating method (1) and the external heating method (2) are combined.

The fixing device employing the internal heating method (1) may comprise a fixing member that itself has a heating device inside. Specific examples of such a heating device include, but are not limited, a heater and a heat source such as halogen lamp.

The fixing device employing the external heating method (2) preferably has a configuration such that at least a part of at least one fixing member is heated by a heating device. Specific examples of such a heating device include, but are not limited to, an electromagnetic induction heater. Preferably, the electromagnetic induction heater includes a magnetic field generator and a heat generator that generates heat by electromagnetic induction. More preferably, the electromagnetic induction heater includes an induction coil to be disposed adjacent to the fixing member (e.g., heating roller), a shielding layer on which the induction coil is disposed, and an insulating layer disposed on the opposite side of the shielding layer on which the induction coil is disposed. In this case, the heating roller preferably comprises a magnetic body or a heat pipe. The induction coil is preferably disposed surrounding the half-cylindrical portion of the heating roller at the opposite side of the contact portion of the heating roller and the fixing member (e.g., pressure roller and endless belt).

Preferably, the nip time for nipping the recording medium at the nip portion is 35 msec or more. The nip time refers to a time during which the recording medium is present on the fixing nip width. When passing through the nip portion, one point on the recording medium and toner thereon are pressurized for the nip time. More preferably, the nip time is from 45 to 65 msec.

Process Cartridge

The process cartridge in accordance with some embodiments of the present invention includes at least an electrostatic latent image bearing member and a developing device, and optionally other devices such a charger, an irradiator, a transfer device, a cleaner, and a neutralizer.

The developing device is configured to develop an electrostatic latent image formed on the electrostatic latent image bearer into a toner image with the toner in accordance with some embodiments of the present invention.

The developing device includes at least a toner container containing the toner and a toner bearer to bear and convey the toner stored in the toner container. The developing device may further include a layer thickness regulator to regulate the thickness of the toner borne on the toner bearer. Preferably, the developing device includes a developer container containing the two-component developer and a developer bearer to bear and convey the two-component developer stored in the developer container. Specifically, the above-exemplified developing device for the image forming apparatus is also preferably used for the process cartridge.

In addition, the above-exemplified charger, irradiator, transfer device, cleaner, and neutralizer for the image forming apparatus can also be used for the process cartridge.

The process cartridge is detachably mountable on various electrophotographic image forming apparatuses, facsimile machines, and printers. Preferably, the process cartridge is detachably mounted on the image forming apparatus in accordance with some embodiments of the present invention.

Figure 2:
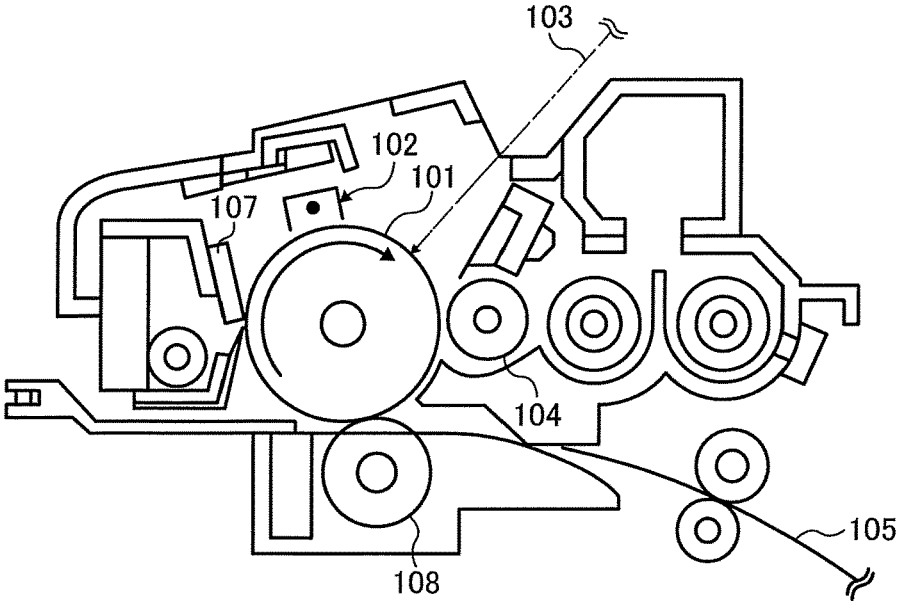
FIG. 2 is a schematic view of a process cartridge in accordance with some embodiments of the present invention.

Referring to FIG. 2, the process cartridge includes an electrostatic latent image bearer 101, a charger 102, a developing device 104, a transfer device 108, and a cleaner 107. In FIG. 2, a numeral 103 denotes a light beam emitted from an irradiator and a numeral 105 denotes a recording medium.

In an image forming operation of the process cartridge illustrated in FIG. 2, the electrostatic latent image bearer 101 is charged by the charger 102 and exposed to the light beam 103 emitted from the irradiator while rotating clockwise in FIG. 2. As a result, an electrostatic latent image is formed on the surface of the electrostatic latent image bearer 101. The electrostatic latent image is developed into a toner image by the developing device 104. The toner image is transferred onto the recording medium 105 by the transfer device 108 and printed out. After image transfer, the surface of the electrostatic latent image bearer 101 is cleaned by the cleaner 107 and neutralized by the neutralizer, and the above-described processes are repeated.

EXAMPLES

The present invention is described in detail with reference to the Examples but is not limited to the following Examples. In the descriptions in the following Examples, the numbers in parts represent mass ratios in parts, unless otherwise specified.

Production Example 1 (Synthesis of Ketimine 1)

In a reaction vessel equipped with a stirrer and a thermometer, 170 parts of isophoronediamine and 75 parts of methyl ethyl ketone were contained and reacted at 50° C. for 5 hours. Thus, a ketimine 1 was prepared. The ketimine compound 1 had an amine value of 418.

Synthesis of Amorphous Polyester Resin A

Production Example A-1 (Synthesis of Amorphous Polyester Resin A-1)

Synthesis of Prepolymer A-1

A reaction vessel equipped with a cooling tube, a stirrer, and a nitrogen introducing tube was charged with diol components comprising 100% by mol of 3-methyl-1,5-pentanediol, dicarboxylic acid components comprising 50% by mol of terephthalic acid (TPA) and 50% by mol of adipic acid (ADA), and 1.5% by mol (based on all monomers) of trimethylolpropane, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further reacted under reduced pressures of from 10 to 15 mmHg for 5 hours. Thus, an intermediate polyester A-1 was prepared.

Next, in a reaction vessel equipped with a cooling tube, a stirrer, and a nitrogen introducing tube, the intermediate polyester A-1 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further reacted at 100° C. for 5 hours. Thus, a prepolymer A-1 was prepared.

Synthesis of Amorphous Polyester Resin A-1

The above-prepared prepolymer A-1 was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A-1, and stirred at 45° C. for 10 hours. Thus, a prepolymer elongated product was obtained. The prepolymer elongated product was dried at 50° C. under reduced pressures until the residual amount of ethyl acetate became 100 ppm or less. Thus, an amorphous polyester resin A-1 was prepared. The amorphous polyester resin A-1 had a weight average molecular weight (Mw) of 164,000 and a Tg of −35° C.

Production Example A-2 (Synthesis of Amorphous Polyester Resin A-2)

Synthesis of Prepolymer A-2

A reaction vessel equipped with a cooling tube, a stirrer, and a nitrogen introducing tube was charged with diol components comprising 100% by mol of 3-methyl-1,5-pentanediol, dicarboxylic acid components comprising 40% by mol of isophthalic acid (IPA) and 60% by mol of adipic acid (ADA), and 1.5% by mol (based on all monomers) of trimethylolpropane, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further reacted under reduced pressures of from 10 to 15 mmHg for 5 hours. Thus, an intermediate polyester A-2 was prepared.

Next, in a reaction vessel equipped with a cooling tube, a stirrer, and a nitrogen introducing tube, the intermediate polyester A-2 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further reacted at 100° C. for 5 hours. Thus, a prepolymer A-2 was prepared.

Synthesis of Amorphous Polyester Resin A-2

The above-prepared prepolymer A-2 was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A-2, and stirred at 45° C. for 10 hours. Thus, a prepolymer elongated product was obtained. The prepolymer elongated product was dried at 50° C. under reduced pressures until the residual amount of ethyl acetate became 100 ppm or less. Thus, an amorphous polyester resin A-2 was prepared. The amorphous polyester resin A-2 had a weight average molecular weight (Mw) of 175,000 and a Tg of −55° C.

Production Example A-3 (Synthesis of Amorphous Polyester Resin A-3)

Synthesis of Prepolymer A-3

A reaction vessel equipped with a cooling tube, a stirrer, and a nitrogen introducing tube was charged with diol components comprising 80% by mol of ethylene oxide 2 mol adduct of bisphenol A and 20% by mol of propylene oxide 2 mol adduct of bisphenol A and dicarboxylic acid components comprising 60% by mol of terephthalic acid and 40% by mol of adipic acid, along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further reacted under reduced pressures of from 10 to 15 mmHg for 5 hours. Thus, an intermediate polyester A-3 was prepared.

Next, in a reaction vessel equipped with a cooling tube, a stirrer, and a nitrogen introducing tube, the intermediate polyester A-3 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further reacted at 100° C. for 5 hours. Thus, a prepolymer A-3 was prepared.

Synthesis of Amorphous Polyester Resin A-3

The above-prepared prepolymer A-3 was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A-3, and stirred at 45° C. for 10 hours. Thus, a prepolymer elongated product was obtained. The prepolymer elongated product was dried at 50° C. under reduced pressures until the residual amount of ethyl acetate became 100 ppm or less. Thus, an amorphous polyester resin A-3 was prepared. The amorphous polyester resin A-3 had a weight average molecular weight (Mw) of 355,000 and a Tg of 45° C.

Production Example A-4 (Synthesis of Amorphous Polyester Resin A-4)

Synthesis of Prepolymer A-4

A reaction vessel equipped with a cooling tube, a stirrer, and a nitrogen introducing tube was charged with diol components comprising 100% by mol of propylene glycol and dicarboxylic acid components comprising 60% by mol of terephthalic acid and 40% by mol of adipic acid (ADA), along with 1,000 ppm (based on the resin components) of titanium tetraisopropoxide, such that the molar ratio (OH/COOH) of hydroxyl groups to carboxyl groups became 1.1. The vessel contents were heated to 200° C. over a period of about 4 hours, thereafter heated to 230° C. over a period of 2 hours, and the reaction was continued until outflow water was no more produced. The vessel contents were further reacted under reduced pressures of from 10 to 15 mmHg for 5 hours. Thus, an intermediate polyester A-4 was prepared.

Next, in a reaction vessel equipped with a cooling tube, a stirrer, and a nitrogen introducing tube, the intermediate polyester A-4 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further reacted at 100° C. for 5 hours. Thus, a prepolymer A-4 was prepared.

Synthesis of Amorphous Polyester Resin A-4

The above-prepared prepolymer A-4 was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A-4, and stirred at 45° C. for 10 hours. Thus, a prepolymer elongated product was obtained. The prepolymer elongated product was dried at 50° C. under reduced pressures until the residual amount of ethyl acetate became 100 ppm or less. Thus, an amorphous polyester resin A-4 was prepared. The amorphous polyester resin A-4 had a weight average molecular weight (Mw) of 320,000 and a Tg of 47° C.

Synthesis of Amorphous Polyester Resin B

Production Example B-1 (Synthesis of Amorphous Polyester Resin B-1)

In a four-neck flask equipped with a nitrogen introducing tube, a dewatering tube, a stirrer, and a thermocouple, alcohol components comprising ethylene oxide 2-mol adduct of bisphenol A (BisA-EO) and propylene oxide 2-mol adduct of bisphenol A (BisA-PO) at a molar ratio (BisA-EO/BisA-PO) of 60/40 and acid components comprising terephthalic acid and adipic acid at a molar ratio (terephthalic acid/adipic acid) of 80/20 were contained, such that the molar ratio (OH/COOH) of hydroxy groups to carboxyl groups became 1.3. After adding 500 ppm (based on the resin components) of titanium tetraisopropoxide to the flask, the flask contents were reacted at 230° C. at normal pressures for 8 hours, and subsequently at reduced pressures of 10 to 15 mmHg for 4 hours. After further adding 1% by mol (based on all the resin components) of trimellitic anhydride to the flask, the flask contents were reacted at 180° C. at normal pressures for 3 hours. Thus, an amorphous polyester resin B-1 was prepared. The amorphous polyester resin B-1 had a weight average molecular weight (Mw) of 9,300 and a Tg of 58° C.

Production Example B-2 (Synthesis of Amorphous Polyester Resin B-2)

In a four-neck flask equipped with a nitrogen introducing tube, a dewatering tube, a stirrer, and a thermocouple, alcohol components comprising ethylene oxide 2-mol adduct of bisphenol A (BisA-EO) and propylene oxide 2-mol adduct of bisphenol A (BisA-PO) at a molar ratio (BisA-EO/BisA-PO) of 90/10 and acid components comprising isophthalic acid and adipic acid at a molar ratio (isophthalic acid/adipic acid) of 80/20 were contained, such that the molar ratio (OH/COOH) of hydroxy groups to carboxyl groups became 1.3. After adding 500 ppm (based on the resin components) of titanium tetraisopropoxide to the flask, the flask contents were reacted at 230° C. at normal pressures for 8 hours, and subsequently at reduced pressures of 10 to 15 mmHg for 4 hours. After further adding 1% by mol (based on all the resin components) of trimellitic anhydride to the flask, the flask contents were reacted at 180° C. at normal pressures for 3 hours. Thus, an amorphous polyester resin B-2 was prepared. The amorphous polyester resin B-2 had a weight average molecular weight (Mw) of 4,300 and a Tg of 44° C.

Production Example B-3 (Synthesis of Amorphous Polyester Resin B-3)

In a four-neck flask equipped with a nitrogen introducing tube, a dewatering tube, a stirrer, and a thermocouple, alcohol components comprising ethylene oxide 2-mol adduct of bisphenol A (BisA-EO) and propylene oxide 2-mol adduct of bisphenol A (BisA-PO) at a molar ratio (BisA-EO/BisA-PO) of 60/40 and acid components comprising isophthalic acid and adipic acid at a molar ratio (isophthalic acid/adipic acid) of 65/35 were contained, such that the molar ratio (OH/COOH) of hydroxy groups to carboxyl groups became 1.3. After adding 500 ppm (based on the resin components) of titanium tetraisopropoxide to the flask, the flask contents were reacted at 230° C. at normal pressures for 8 hours, and subsequently at reduced pressures of 10 to 15 mmHg for 4 hours. After further adding 1% by mol (based on all the resin components) of trimellitic anhydride to the flask, the flask contents were reacted at 180° C. at normal pressures for 3 hours. Thus, an amorphous polyester resin B-3 was prepared. The amorphous polyester resin B-3 had a weight average molecular weight (Mw) of 5,300 and a Tg of 50° C.

Synthesis of Crystalline Polyester Resin C

Production Example C (Synthesis of Crystalline Polyester Resin C)

A 5-L four-neck flask equipped with a nitrogen introducing tube, a dewatering tube, a stirrer, and a thermocouple, sebacic acid and 1,6-hexanediol were contained, such that the molar ratio (OH/COOH) of hydroxyl groups to carboxyl groups became 0.9. After adding 500 ppm (based on the resin components) of titanium tetraisopropoxide to the flask, the flask contents were reacted at 180° C. for 10 hours, thereafter at 200° C. for 3 hours, and further under a pressure of 8.3 kPa for 2 hours. Thus, a crystalline polyester resin C-1 was prepared.

Preparation of Master Batch

Production Example P-1 (Yellow Master Batch)

First, 100 parts by mass of the amorphous polyester resin B-1, 100 parts by mass of a yellow pigment (C.I. Pigment Yellow 185), and 50 parts by mass of ion-exchange water were well mixed and kneaded by an open roll kneader (NEADEX available from NIPPON COKE & ENGINEERING. CO., LTD. (former Mitsui Mining Co., Ltd.)). The kneading temperature was initially 80° C. and thereafter raised to 120° C. By removing water, a colorant master batch P-1 was prepared in which the mass ratio between resin and pigment was 1:1.

Production Example P-2 (Magenta Master Batch)

First, 100 parts by mass of the amorphous polyester resin B-1, 100 parts by mass of a magenta pigment (C.I. Pigment Red 269), and 50 parts by mass of ion-exchange water were well mixed and kneaded by an open roll kneader (NEADEX available from NIPPON COKE & ENGINEERING. CO., LTD. (former Mitsui Mining Co., Ltd.)). The kneading temperature was initially 80° C. and thereafter raised to 120° C. By removing water, a colorant master batch P-2 was prepared in which the mass ratio between resin and pigment was 1:1.

Production Example P-3 (Cyan Master Batch)

First, 100 parts by mass of the amorphous polyester resin B-1, 100 parts by mass of a cyan pigment (C.I. Pigment Blue 15:3), and 50 parts by mass of ion-exchange water were well mixed and kneaded by an open roll kneader (NEADEX available from NIPPON COKE & ENGINEERING. CO., LTD. (former Mitsui Mining Co., Ltd.)). The kneading temperature was initially 80° C. and thereafter raised to 120° C. By removing water, a colorant master batch P-3 was prepared in which the mass ratio between resin and pigment was 1:1.

Preparation of Carrier

As a core material, 5,000 parts by mass of a particulate manganese (Mn) ferrite (having a weight average particle diameter of 35 μm) was used. A coating liquid was prepared by dispersing 300 parts by mass of toluene, 300 parts by mass of butyl cellosolve, 60 parts by mass of a toluene solution of an acrylic resin (comprising methacrylic acid, methyl methacrylate, and 2-hydroxyethyl acrylate at a ratio of 5:9:3, having a Tg of 38° C.) having a solid content concentration of 50% by mass, 15 parts by mass of a toluene solution of a N-tetramethoxymethylbenzoguanamine resin (having a polymerization degree of 1.5) having a solid content concentration of 77% by mass, and 15 parts by mass of a particulate alumina (having an average primary particle diameter of 0.30 μm) with a stirrer for 10 minutes. The core material was coated with the coating liquid by a coating device that performs a coating treatment in a fluidized bed equipped with a rotary bottom disc and an agitation blade while forming a swirl flow. The coated core material was calcined in an electric furnace at 220° C. for 2 hours. Thus, a carrier was prepared.

Image Forming Apparatus A

An image forming apparatus A that was used to evaluate the below-prepared toners is described in detail below.

Figure 3:
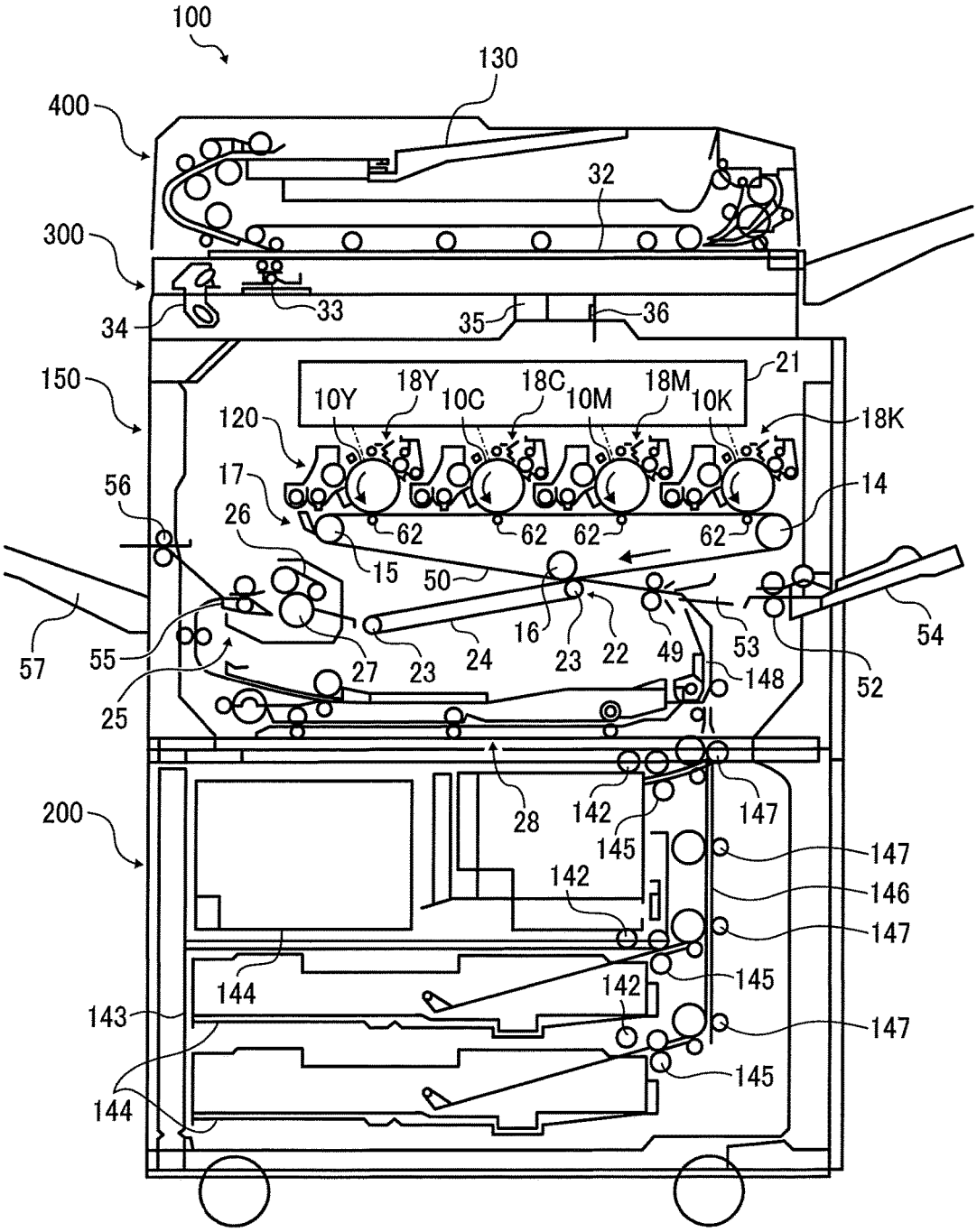
FIG. 3 is a schematic view of a tandem-type image forming apparatus used in Examples.

The image forming apparatus A was a tandem-type full-color image forming apparatus 100 illustrated in FIG. 3. An image forming apparatus A (100) includes a copier main body 150, a sheet feed table 200, a scanner 300, and an automatic document feeder (ADF) 400.

In the central part of the copier main body 150, an intermediate transfer medium 50 in the form of an endless belt is disposed. The intermediate transfer medium 50 is stretched taut with support rollers 14, 15, and 16 and rotatable clockwise in FIG. 3. In the vicinity of the support roller 15, an intermediate transfer medium cleaner 17 is disposed for removing residual toner particles remaining on the intermediate transfer medium 50. Four image forming units 18Y, 18C, 18M, and 18K (hereinafter collectively "image forming units 18") for forming yellow, cyan, magenta, and black images, respectively, are arranged in tandem facing a part of the intermediate transfer medium 50 stretched between the support rollers 14 and 15, thus forming a tandem developing device 120. In the vicinity of the tandem developing device 120, an irradiator 21 is disposed. A secondary transfer device 22 is disposed on the opposite side of the tandem developing device 120 relative to the intermediate transfer medium 50. The secondary transfer device 22 includes a secondary transfer belt 24 in the form of an endless belt stretched taut with a pair of rollers 23. A recording medium conveyed on the secondary transfer belt 24 and the intermediate transfer medium 50 can contact with each other. In the vicinity of the secondary transfer device 22, a fixing device 25 is disposed.

In the vicinity of the secondary transfer device 22 and the fixing device 25, a sheet reversing device 28 is disposed for reversing the recording medium so that images can be formed on both surfaces of the recording medium.

A procedure for forming a full-color image with the tandem developing device 120 is described below.

Figure 4:
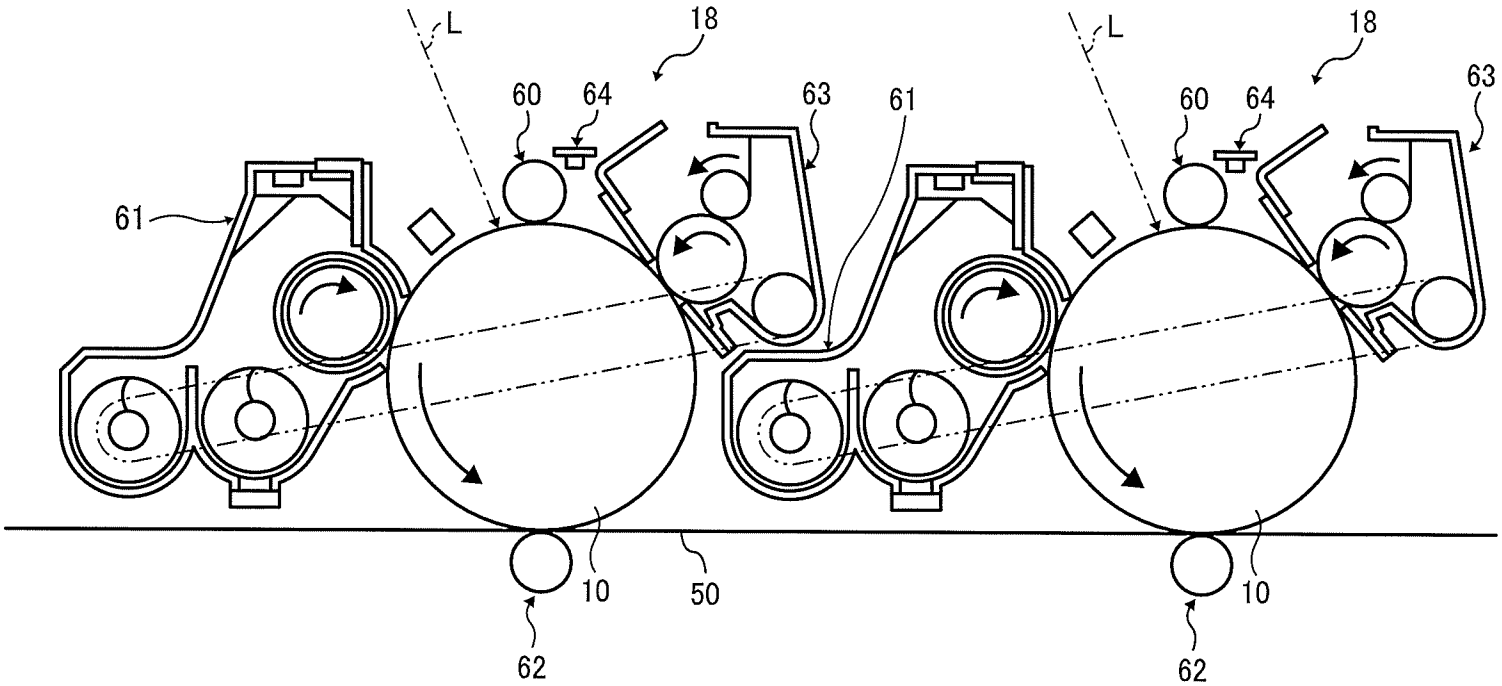
FIG. 4 is a partial magnified view of an image forming unit illustrated in FIG. 3.

First, a document is set on a document table 130 of the automatic document feeder 400. Alternatively, a document is set on a contact glass 32 of the scanner 300 while the automatic document feeder 400 is lifted up, followed by holding down of the automatic document feeder 400. As a start switch is pressed, the scanner 300 starts driving after the document is moved onto the contact glass 32 in a case in which a document is set on the contact glass 32, or the scanner 300 immediately starts driving in a case in which a document is set on the automatic document feeder 400, so that a first traveling body 33 and a second traveling body 34 start traveling. The first traveling body 33 directs light emitted from a light source to the document. A mirror carried by the second traveling body 34 reflects light reflected from the document toward a reading sensor 36 through an imaging lens 35. Thus, the document is read by the reading sensor 36 and converted into image information of yellow, magenta, and cyan. The image information of yellow, magenta, and cyan are respectively transmitted to the image forming units 18Y, 18M, and 18C, respectively, in the tandem developing device 120, so that toner images of yellow, magenta, and cyan are respectively formed. The image forming units 18Y, 18M, and 18C (hereinafter each referred to as "image forming unit 18") include respective electrostatic latent image bearers 10Y, 10M, and 10C (hereinafter each referred to as "electrostatic latent image bearer 10"), as illustrated in FIG. 4. Further, each image forming unit 18 includes a charger 60 to uniformly charge each electrostatic latent image bearer 10, an irradiator to irradiate each electrostatic latent image bearer 10 with light L based on the color image information to form an electrostatic latent image thereon, a developing device 61 to develop the electrostatic latent image with each toner (yellow toner, magenta toner, or cyan toner) to form a toner image, a transfer charger 62 to transfer the toner image onto the intermediate transfer medium 50, a cleaner 63, and a neutralizer 64. The image forming units 18Y, 18M, and 18C are capable of forming respective single-color images, i.e., yellow image, magenta image, and cyan image, respectively. The toner images of yellow, magenta, and cyan are primarily transferred from the respective electrostatic latent image bearers 10Y, 10M, and 10C in a sequential manner onto the intermediate transfer medium 50 that is rotated by the support rollers 14, 15, and 16. Thus, the toner images of yellow, magenta, and cyan are superimposed on one another on the intermediate transfer medium 50, thus forming a composite full-color toner image.

At the same time, in the sheet feed table 200, one of sheet feed rollers 142 starts rotating to feed sheets of recording medium from one of sheet feed cassettes 144 in a sheet bank 143. One of separation rollers 145 separates the sheets one by one and feeds them to a sheet feed path 146. Feed rollers 147 feed each sheet to a sheet feed path 148 in the copier main body 150. The sheet is stopped by striking a registration roller 49. Alternatively, sheets may be fed from a manual feed tray 54. In this case, a separation roller 52 separates the sheets one by one and feeds it to a manual sheet feed path 53. The sheet is stopped by striking the registration roller 49. The registration roller 49 is generally grounded. Alternatively, the registration roller 49 may be applied with a bias for the purpose of removing paper powders from the sheet. The registration roller 49 starts rotating to feed the sheet to between the intermediate transfer medium 50 and the secondary transfer device 22 in synchronization with an entry of the composite full-color toner image formed on the intermediate transfer medium 50 thereto. The secondary transfer device 22 secondarily transfers the composite full-color toner image onto the sheet. After the composite full-color image is transferred, residual toner particles remaining on the intermediate transfer medium 50 are removed by the intermediate transfer medium cleaner 17.

The sheet having the composite full-color toner image thereon is fed from the secondary transfer device 22 to the fixing device 25. The fixing device 25 fixes the composite full-color toner image on the sheet by application of heat and pressure. A switch claw 55 switches sheet feed paths so that the sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57. In FIG. 3, numerals 26 and 27 respectively denote a fixing belt and a pressure roller.

In the image forming apparatus A (100), image conveyance flaws and/or glossy stripes (generally generated when contacting conveyance members, ejection rollers, and/or conveyance rollers) are generated when the fixed image contacts the ejection roller 56 and/or conveyance rollers members disposed in the reversing device 28.

Example 1

Preparation of Wax Dispersion Liquid

In a vessel equipped with a stirrer and a thermometer, 50 parts of a paraffin wax (HNP-9 available from NIPPON SEIRO CO., LTD., a hydrocarbon wax having a melting point of 75° C. and a solubility parameter (SP) of 8.8), serving as a release agent 1 and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Thus, a wax dispersion liquid 1 was prepared.

Preparation of Crystalline Polyester Resin Dispersion Liquid 1

In a vessel equipped with a stirrer and a thermometer, 50 parts of the crystalline polyester resin C-1 and 450 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 msec. This dispersing operation was repeated 3 times (3 passes). Thus, a crystalline polyester resin dispersion liquid 1 was prepared.

Preparation of Oil Phase 1

In a vessel, 150 parts of the wax dispersion liquid 1, 50 parts of the amorphous polyester resin A-1, 100 parts of the amorphous polyester resin A-3, 50 parts of the crystalline polyester resin dispersion liquid 1, 750 parts of the amorphous polyester resin B-1, 50 parts of the yellow colorant master batch P-1, and 2 parts of the ketimine compound 1 were mixed with a TK HOMOMIXER (available from PRIMIX Corporation) at a revolution of 5,000 rpm for 60 minutes. Thus, an oil phase 1 was prepared.

Preparation of Fine Particle Dispersion Liquid 1

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

Preparation of Aqueous Phase

An aqueous phase 1 was prepared by stir-mixing 937 parts of water, 83 parts of the fine particle dispersion liquid 1, 90 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In the vessel containing the oil phase 1, 1,200 parts of the aqueous phase 1 was added and mixed with a TK HOMOMIXER at a revolution of 13,000 rpm for 20 minutes. Thus, an emulsion slurry 1 was prepared.

The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, (1) 100 parts of ion-exchange water was added to the filter cake and mixed therewith using a TK HOMOMIXER at a revolution of 12,000 rpm for 10 minutes, followed by filtration; (2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures; (3) 100 parts of a 10% aqueous solution of hydrochloric was added to the filter cake of (2) and mixed therewith using a TK HOMOMIXER at a revolution of 12,000 rpm for 10 minutes, followed by filtration; and (4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake 1.

The filter cake 1 was dried by a circulating air dryer at 45° C. for 48 hours and then filtered with a mesh having an opening of 75 μm. Thus, a toner 1 was prepared.

Example 2

The procedure in Example 1 was repeated except that the oil phase was prepared with the magenta colorant master batch P-2, thus obtaining a toner of Example 2.

Example 3

The procedure in Example 1 was repeated except that the oil phase was prepared with the cyan colorant master batch P-3, thus obtaining a toner of Example 3.

Example 4

The procedure in Example 1 was repeated to obtain a toner of Example 4. In the following evaluation, the nip time was changed.

Example 5

The procedure in Example 2 was repeated to obtain a toner of Example 5. In the following evaluation, the nip time was changed.

Example 6

The procedure in Example 3 was repeated to obtain a toner of Example 6. In the following evaluation, the nip time was changed.

Example 7

The procedure in Example 1 was repeated except that the oil phase was prepared with 60 parts of the amorphous polyester resin A-1, 90 parts of the amorphous polyester resin A-3, 50 parts of the crystalline polyester resin dispersion liquid 1, and 750 parts of the amorphous polyester resin B-1, thus obtaining a toner of Example 7.

Example 8

The procedure in Example 7 was repeated except that the oil phase was prepared with the magenta colorant master batch P-2, thus obtaining a toner of Example 8.

Example 9

The procedure in Example 7 was repeated except that the oil phase was prepared with the cyan colorant master batch P-3, thus obtaining a toner of Example 9.

Example 10

The procedure in Example 1 is repeated except that the oil phase is prepared with 40 parts of the amorphous polyester resin A-2, 110 parts of the amorphous polyester resin A-3, 50 parts of the crystalline polyester resin dispersion liquid 1, and 750 parts of the amorphous polyester resin B-1, thus obtaining a toner of Example 10.

Example 11

The procedure in Example 10 is repeated except that the oil phase is prepared with the magenta colorant master batch P-2, thus obtaining a toner of Example 11.

Example 12

The procedure in Example 10 is repeated except that the oil phase is prepared with the cyan colorant master batch P-3, thus obtaining a toner of Example 12.

Example 13

The procedure in Example 1 is repeated except that the oil phase is prepared with 75 parts of the amorphous polyester resin A-1, 75 parts of the amorphous polyester resin A-3, 50 parts of the crystalline polyester resin dispersion liquid 1, and 750 parts of the amorphous polyester resin B-1, thus obtaining a toner of Example 13.

Example 14

The procedure in Example 13 is repeated except that the oil phase is prepared with the magenta colorant master batch P-2, thus obtaining a toner of Example 14.

Example 15

The procedure in Example 13 is repeated except that the oil phase is prepared with the cyan colorant master batch P-3, thus obtaining a toner of Example 15.

Example 16

The procedure in Example 1 is repeated except that the oil phase is prepared with 50 parts of the amorphous polyester resin A-2, 100 parts of the amorphous polyester resin A-3, 50 parts of the crystalline polyester resin dispersion liquid 1, and 750 parts of the amorphous polyester resin B-1, thus obtaining a toner of Example 16.

Example 17

The procedure in Example 16 is repeated except that the oil phase is prepared with the magenta colorant master batch P-2, thus obtaining a toner of Example 17.

Example 18

The procedure in Example 16 is repeated except that the oil phase is prepared with the cyan colorant master batch P-3, thus obtaining a toner of Example 18.

Comparative Example 1

The procedure in Example 1 was repeated except that the oil phase was prepared with 120 parts of the amorphous polyester resin A-1, 30 parts of the amorphous polyester resin A-3, 50 parts of the crystalline polyester resin dispersion liquid 1, and 750 parts of the amorphous polyester resin B-1, thus obtaining a toner of Comparative Example 1.

Comparative Example 2

The procedure in Comparative Example 1 was repeated except that the oil phase was prepared with the magenta colorant master batch P-2, thus obtaining a toner of Comparative Example 2.

Comparative Example 3

The procedure in Comparative Example 1 was repeated except that the oil phase was prepared with the cyan colorant master batch P-3, thus obtaining a toner of Comparative Example 3.

Comparative Example 4

The procedure in Example 1 was repeated except that the oil phase was prepared with 150 parts of the amorphous polyester resin A-3, 50 parts of the crystalline polyester resin dispersion liquid 1, and 750 parts of the amorphous polyester resin B-2, thus obtaining a toner of Comparative Example 4.

Comparative Example 5

The procedure in Comparative Example 4 was repeated except that the oil phase was prepared with the magenta colorant master batch P-2, thus obtaining a toner of Comparative Example 5.

Comparative Example 6

The procedure in Comparative Example 4 was repeated except that the oil phase was prepared with the cyan colorant master batch P-3, thus obtaining a toner of Comparative Example 6.

Comparative Example 7

The procedure in Example 1 was repeated except that the oil phase was prepared with 100 parts of the amorphous polyester resin A-4, 50 parts of the amorphous polyester resin A-3, 50 parts of the crystalline polyester resin dispersion liquid 1, and 750 parts of the amorphous polyester resin B-3, thus obtaining a toner of Comparative Example 7.

Comparative Example 8

The procedure in Comparative Example 7 was repeated except that the oil phase was prepared with the magenta colorant master batch P-2, thus obtaining a toner of Comparative Example 8.

Comparative Example 9

The procedure in Comparative Example 7 was repeated except that the oil phase was prepared with the cyan colorant master batch P-3, thus obtaining a toner of Comparative Example 9.

Quality Evaluations

The above-prepared toners and developers were evaluated as follows.

Evaluation of Image Quality

An image forming apparatus IMAGEO MP C4300 (product of Ricoh Co., Ltd.) and a recording sheet POD GLOSS COAT PAPER (product of Oji Paper Co., Ltd.) were used for the evaluation.

An image for quality evaluation including a 30-mm-square single-color solid portion was formed on the recording sheet while adjusting the toner deposition amount on the developing roller to 0.6 mg/cm$^2$, so that the toner deposition amount on the single-color solid portion in an unfixed toner image became 0.5 mg/cm$^2$.

After adjusting the nip time of the image forming apparatus according to Table 2, the image was formed and fixed on the recording sheet.

The fixed image was subjected to a measurement of optical density indicating image density and chromaticness indexes a* and b* defined in the L*a*b* color system (CIE:1976) using a spectrophotometric densitometer (X-Rite 938 available from X-Rite), and the chroma was calculated from the following formula (1).

$$(\text{Chroma})=[(a^*)^2+(b^*)^2]^{1/2} \quad \text{Formula (1)}$$

Image quality was evaluated based on the following criteria.

(a) Magenta Toner

A: Good. The optical density was 1.35 or greater, and the chroma was 65 or greater.

B: Slightly good. The optical density was 1.35 or greater, and the chroma was 60 or greater and less than 65.

C: Slightly poor. The optical density was 1.30 or greater, and the chroma was 60 or greater and less than 65.

D: Poor. The optical density was less than 1.30, and the chroma was less than 60.

(b) Cyan Toner

A: Good. The optical density was 1.40 or greater, and the chroma was 50 or greater.

B: Slightly good. The optical density was 1.40 or greater, and the chroma was 45 or greater and less than 50.

C: Slightly poor. The optical density was 1.35 or greater, and the chroma was 45 or greater and less than 50.

D: Poor. The optical density was less than 1.35, and the chroma was less than 45.

(c) Yellow Toner

A: Good. The optical density was 1.35 or greater, and the chroma was 85 or greater.

B: Slightly good. The optical density was 1.35 or greater, and the chroma was 80 or greater and less than 85.

C: Slightly poor. The optical density was 1.30 or greater, and the chroma was 80 or greater and less than 50.

D: Poor. The optical density was less than 1.30, and the chroma was less than 80.

Evaluation of Low-Temperature Fixability and Hot Offset Resistance

Each of the above-prepared developers was set in the image forming apparatus A. A solid image having a toner deposition amount of 0.85±0.10 mg/cm$^2$ and an image area of 3 cm×8 cm was formed on multiple sheets of a transfer paper (printing paper <70> available from Ricoh Japan Co., Ltd.), and the solid image was fixed on each sheet while varying the temperature of the fixing belt. The fixed image was subjected to a scratch drawing test with a drawing tester AD-401 (available from Ueshima Seisakusho Co., Ltd.) equipped with a ruby needle (having a point radius of from 260 to 320 μmR and a point angle of 60 degrees) at a load of 50 g. The surface of the image was then strongly rubbed with a piece of a fabric (HONECOTTO #440 from SAKATA INX ENG. CO., LTD) for 5 times. The temperature of the fixing belt at which almost no peeling-off of the image occurred was determined as the lower-limit fixable temperature. The upper-limit temperature at which no hot offset occurred (i.e., the upper-limit fixable temperature) was also determined to evaluate hot offset resistance. The solid image was formed on a position on the sheet 3.0 cm away from the leading edge in the sheet feeding direction. The velocity of the sheet passing through the nip portion of the fixing device was 280 mm/s. The lower the lower-limit fixable temperature, the better the low-temperature fixability.

Evaluation Criteria for Low-Temperature Fixability

A: The lower-limit fixable temperature was 130° C. or less.

B: The lower-limit fixable temperature was in the range of from 131° C. to 135° C.

C: The lower-limit fixable temperature was in the range of from 136° C. to 140° C.

D: The lower-limit fixable temperature was 141° C. or greater.

Evaluation Criteria for Hot Offset Resistance

A: The upper-limit fixable temperature was 175° C. or greater.

B: The upper-limit fixable temperature was 170° C. or greater and less than 175° C.

C: The upper-limit fixable temperature was 165° C. or greater and less than 170° C.

D: The upper-limit fixable temperature was less than 165° C.

Evaluation of Gloss Evenness

Figure 5:
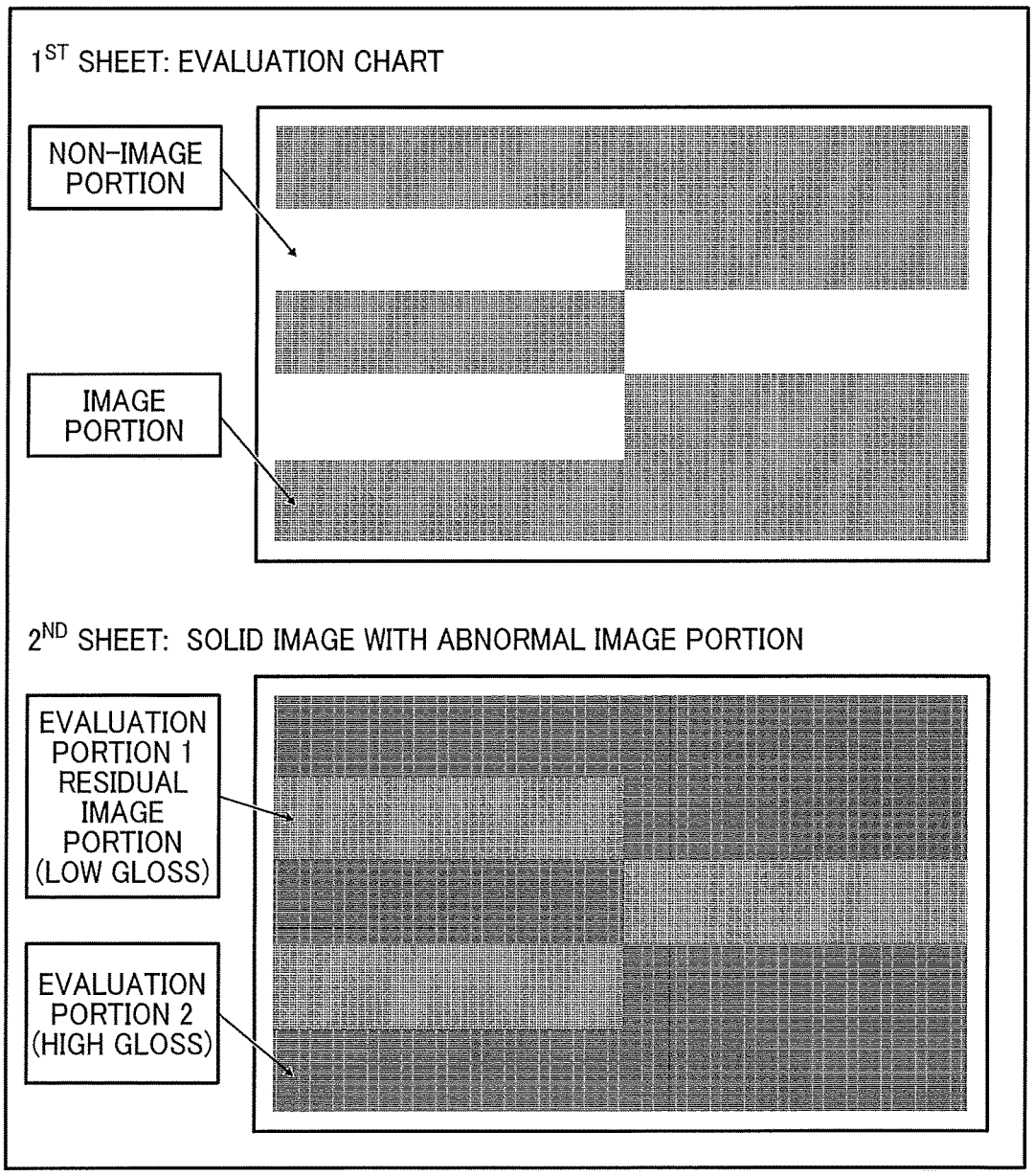
FIG. 5 is an illustration for explaining a test for evaluating gloss evenness in Examples.

A first evaluation chart having a toner deposition amount of 1.00±0.03 mg/cm$^2$, illustrated on the upper side of FIG. 5, and a second evaluation chart comprising a solid image were continuously formed on respective first and second sheets of MONDI COLOR COPY 300 (available from Mondi, having a basis weight of 300 g/m$^2$) by the image forming apparatus A while setting the sheet feed linear velocity to 400 mm/sec, the surface pressure to 1.6 kgf/cm$^2$, and the nip width to 15 mm. The images were fixed at various temperatures. At each temperature, the solid image fixed on the second sheet was subjected to an evaluation of gloss evenness. To evaluate gloss of residual image, 3 randomly-selected portions within each of the evaluation portions 1 and 2 on the second sheet, illustrated in FIG. 5, were subjected to a measurement of 60-degree gloss value using a gloss meter VG-7000 (available from NIPPON DENSHOKU INDUSTRIES CO., LTD.). The average gloss values in each of the evaluation portions 1 and 2 were determined and the fixing temperature at which the difference therebetween became 20% or more was determined. Gloss evenness was evaluated by the fixing temperature at which the gloss difference became 20% or more based on the following criteria.

A: The fixing temperature was 190° C., or the gloss difference never became 20% or more.

B: The fixing temperature was 180° C. or greater and less than 190° C.

C: The fixing temperature was 170° C. or greater and less than 180° C.

D: The fixing temperature was less than 170° C.

Evaluation of Heat-Resistant Storage Stability

In a 50-ml glass vessel, 10 g of each toner was sufficiently tapped until the apparent density of the toner powder no longer changed. The vessel was capped and left to stand in a thermostatic chamber at 50° C. for 24 hours and thereafter cooled to 24° C. The toner was then subjected to a penetration test according to JIS (Japanese industrial Standards) K2235-1991 to measure a penetration (mm). Heat-resistant storage stability was evaluated by the penetration based on the following criteria. The greater the penetration, the better the heat-resistant storage stability. Those having a penetration of less than 15 mm (fallen into C or D) are highly likely to cause problems in use.

Evaluation Criteria

A: Penetration was 20 mm or greater.

B: Penetration was 15 mm or greater and less than 20 mm.

C: Penetration was 10 mm or greater and less than 15 mm.

D: Penetration was less than 10 mm.

Evaluation of Low Glossiness

A copy test was performed by a copier MF2200 (available from Ricoh Co., Ltd.) employing a TEFLON® roller as the fixing roller, the fixing unit of which had been modified, using a paper TYPE 6200 (available from Ricoh Co., Ltd.). The fixing temperature was set to a temperature 20° C. higher than the lower-limit fixable temperature that had been determined in the above evaluation of low-temperature fixability. The sheet feed linear velocity was set to 120 to 150 mm/sec, the surface pressure was set to 1.2 kgf/cm$^2$, and the nip width was set to 3 mm. The fixed image was subjected to a measurement of 60-degree gloss value with a gloss meter VG-7000 (available from NIPPON DENSHOKU INDUSTRIES CO., LTD.).

Evaluation Criteria

A: The gloss value was less than 30%.

B: The gloss value was 30% or greater and less than 35%.

C: The gloss value was 35% or greater and less than 40%.

D: The gloss value was 40% or greater.

Composition of each toner is shown in Table 1. Evaluation results are shown in Table 2.

TABLE 1

| | Amorphous Polyester Resin (1) | | | | Amorphous Polyester Resin (2) | | | |
|---|---|---|---|---|---|---|---|---|
| | Composition | | Name | Parts by mass | Composition | | Name | Parts by mass |
| Example 1 | 3-Methyl-1,5-pentanediol | TPA/ADA 50/50 | A-1 | 50 | BisAEO/PO 8/2 | TPA/ADA 60/40 | A-3 | 100 |
| Example 2 | 3-Methyl-1,5-pentanediol | TPA/ADA 50/50 | A-1 | 50 | BisAEO/PO 8/2 | TPA/ADA 60/40 | A-3 | 100 |
| Example 3 | 3-Methyl-1,5-pentanediol | TPA/ADA 50/50 | A-1 | 50 | BisAEO/PO 8/2 | TPA/ADA 60/40 | A-3 | 100 |
| Example 4 | 3-Methyl-1,5-pentanediol | TPA/ADA 50/50 | A-1 | 50 | BisAEO/PO 8/2 | TPA/ADA 60/40 | A-3 | 100 |
| Example 5 | 3-Methyl-1,5-pentanediol | TPA/ADA 50/50 | A-1 | 50 | BisAEO/PO 8/2 | TPA/ADA 60/40 | A-3 | 100 |
| Example 6 | 3-Methyl-1,5-pentanediol | TPA/ADA 50/50 | A-1 | 50 | BisAEO/PO 8/2 | TPA/ADA 60/40 | A-3 | 100 |
| Example 7 | 3-Methyl-1,5-pentanediol | TPA/ADA 50/50 | A-1 | 60 | BisAEO/PO 8/2 | TPA/ADA 60/40 | A-3 | 90 |
| Example 8 | 3-Methyl-1,5-pentanediol | TPA/ADA 50/50 | A-1 | 60 | BisAEO/PO 8/2 | TPA/ADA 60/40 | A-3 | 90 |
| Example 9 | 3-Methyl-1,5-pentanediol | TPA/ADA 50/50 | A-1 | 60 | BisAEO/PO 8/2 | TPA/ADA 60/40 | A-3 | 90 |
| Example 10 | 3-Methyl-1,5-pentanediol | IPA/ADA 40/60 | A-2 | 40 | BisAEO/PO 8/2 | TPA/ADA 60/40 | A-3 | 110 |
| Example 11 | 3-Methyl-1,5-pentanediol | IPA/ADA 40/60 | A-2 | 40 | BisAEO/PO 8/2 | TPA/ADA 60/40 | A-3 | 110 |
| Example 12 | 3-Methyl-1,5-pentanediol | IPA/ADA 40/60 | A-2 | 40 | BisAEO/PO 8/2 | TPA/ADA 60/40 | A-3 | 110 |
| Example 13 | 3-Methyl-1,5-pentanediol | TPA/ADA 50/50 | A-1 | 75 | BisAEO/PO 8/2 | TPA/ADA 60/40 | A-3 | 75 |

TABLE 1-continued

| | | | | | | | | |
|---|---|---|---|---|---|---|---|---|
| Example 14 | 3-Methyl-1,5-pentanediol | TPA/ADA 50/50 | A-1 | 75 | BisAEO/PO 8/2 | TPA/ADA 60/40 | A-3 | 75 |
| Example 15 | 3-Methyl-1,5-pentanediol | TPA/ADA 50/50 | A-1 | 75 | BisAEO/PO 8/2 | TPA/ADA 60/40 | A-3 | 75 |
| Example 16 | 3-Methyl-1,5-pentanediol | IPA/ADA 40/60 | A-2 | 50 | BisAEO/PO 8/2 | TPA/ADA 60/40 | A-3 | 100 |
| Example 17 | 3-Methyl-1,5-pentanediol | IPA/ADA 40/60 | A-2 | 50 | BisAEO/PO 8/2 | TPA/ADA 60/40 | A-3 | 100 |
| Example 18 | 3-Methyl-1,5-pentanediol | IPA/ADA 40/60 | A-2 | 50 | BisAEO/PO 8/2 | TPA/ADA 60/40 | A-3 | 100 |
| Comparative Example 1 | 3-Methyl-1,5-pentanediol | TPA/ADA 50/50 | A-1 | 120 | BisAEO/PO 8/2 | TPA/ADA 60/40 | A-3 | 30 |
| Comparative Example 2 | 3-Methyl-1,5-pentanediol | TPA/ADA 50/50 | A-1 | 120 | BisAEO/PO 8/2 | TPA/ADA 60/40 | A-3 | 30 |
| Comparative Example 3 | 3-Methyl-1,5-pentanediol | TPA/ADA 50/50 | A-1 | 120 | BisAEO/PO 8/2 | TPA/ADA 60/40 | A-3 | 30 |
| Comparative Example 4 | BisAEO/PO 8/2 | TPA/ADA 60/40 | A-3 | 150 | — | — | — | — |
| Comparative Example 5 | BisAEO/PO 8/2 | TPA/ADA 60/40 | A-3 | 150 | — | — | — | — |
| Comparative Example 6 | BisAEO/PO 8/2 | TPA/ADA 60/40 | A-3 | 150 | — | — | — | — |
| Comparative Example 7 | Propylene glycol | TPA/ADA 80/20 | A-4 | 100 | BisAEO/PO 8/2 | TPA/ADA 60/40 | A-3 | 50 |
| Comparative Example 8 | Propylene glycol | TPA/ADA 80/20 | A-4 | 100 | BisAEO/PO 8/2 | TPA/ADA 60/40 | A-3 | 50 |
| Comparative Example 9 | Propylene glycol | TPA/ADA 80/20 | A-4 | 100 | BisAEO/PO 8/2 | TPA/ADA 60/40 | A-3 | 50 |

| | Amorphous Polyester Resin (3) | | | | |
|---|---|---|---|---|---|
| | Composition | | Name | Parts by mass | MB |
| Example 1 | BisAEO/PO 6/4 | TPA/ADA 80/20 | B-1 | 750 | P-1 |
| Example 2 | BisAEO/PO 6/4 | TPA/ADA 80/20 | B-1 | 750 | P-2 |
| Example 3 | BisAEO/PO 6/4 | TPA/ADA 80/20 | B-1 | 750 | P-3 |
| Example 4 | BisAEO/PO 6/4 | TPA/ADA 80/20 | B-1 | 750 | P-1 |
| Example 5 | BisAEO/PO 6/4 | TPA/ADA 80/20 | B-1 | 750 | P-2 |
| Example 6 | BisAEO/PO 6/4 | TPA/ADA 80/20 | B-1 | 750 | P-3 |
| Example 7 | BisAEO/PO 6/4 | TPA/ADA 80/20 | B-1 | 750 | P-1 |
| Example 8 | BisAEO/PO 6/4 | TPA/ADA 80/20 | B-1 | 750 | P-2 |
| Example 9 | BisAEO/PO 6/4 | TPA/ADA 80/20 | B-1 | 750 | P-3 |
| Example 10 | BisAEO/PO 6/4 | TPA/ADA 80/20 | B-1 | 750 | P-1 |
| Example 11 | BisAEO/PO 6/4 | TPA/ADA 80/20 | B-1 | 750 | P-2 |
| Example 12 | BisAEO/PO 6/4 | TPA/ADA 80/20 | B-1 | 750 | P-3 |
| Example 13 | BisAEO/PO 6/4 | TPA/ADA 80/20 | B-1 | 750 | P-1 |
| Example 14 | BisAEO/PO 6/4 | TPA/ADA 80/20 | B-1 | 750 | P-2 |
| Example 15 | BisAEO/PO 6/4 | TPA/ADA 80/20 | B-1 | 750 | P-3 |
| Example 16 | BisAEO/PO 6/4 | TPA/ADA 80/20 | B-1 | 750 | P-1 |
| Example 17 | BisAEO/PO 6/4 | TPA/ADA 80/20 | B-1 | 750 | P-2 |
| Example 18 | BisAEO/PO 6/4 | TPA/ADA 80/20 | B-1 | 750 | P-3 |
| Comparative Example 1 | BisAEO/PO 6/4 | TPA/ADA 80/20 | B-1 | 750 | P-1 |
| Comparative Example 2 | BisAEO/PO 6/4 | TPA/ADA 80/20 | B-1 | 750 | P-2 |
| Comparative Example 3 | BisAEO/PO 6/4 | TPA/ADA 80/20 | B-1 | 750 | P-3 |
| Comparative Example 4 | BisAEO/PO 9/1 | IPA/ADA 80/20 | B-2 | 750 | P-1 |
| Comparative Example 5 | BisAEO/PO 9/1 | IPA/ADA 80/20 | B-2 | 750 | P-2 |
| Comparative Example 6 | BisAEO/PO 9/1 | IPA/ADA 80/20 | B-2 | 750 | P-3 |
| Comparative Example 7 | BisAEO/PO 6/4 | IPA/ADA 65/35 | B-3 | 750 | P-1 |
| Comparative Example 8 | BisAEO/PO 6/4 | IPA/ADA 65/35 | B-3 | 750 | P-2 |
| Comparative Example 9 | BisAEO/PO 6/4 | IPA/ADA 65/35 | B-3 | 750 | P-3 |

TABLE 2

| | tan δ (100° C.) | tan δ (130° C.) | G' (100° C.) | G' (160° C.) | Tg (° C.) | Nip Time (msec) | Image Quality | Low-temperature Fixability | Hot Offset Resistance | Gloss Evenness | Heat-resistanet Storage Stability |
|---|---|---|---|---|---|---|---|---|---|---|---|
| Example 1 | 1.4 | 1.2 | $5.0 \times 10^4$ | $1.3 \times 10^3$ | 56 | 55 | A | A | A | A | A |
| Example 2 | 1.5 | 1.4 | $4.2 \times 10^4$ | $1.1 \times 10^3$ | 55 | 55 | A | A | A | A | A |
| Example 3 | 1.4 | 1.2 | $4.5 \times 10^4$ | $1.3 \times 10^3$ | 56 | 55 | A | A | A | A | A |
| Example 4 | 1.4 | 1.2 | $5.0 \times 10^4$ | $1.2 \times 10^3$ | 56 | 35 | C | A | A | A | A |
| Example 5 | 1.5 | 1.4 | $4.2 \times 10^4$ | $1.1 \times 10^3$ | 55 | 45 | B | A | A | A | A |
| Example 6 | 1.4 | 1.2 | $4.5 \times 10^4$ | $1.3 \times 10^3$ | 56 | 65 | A | A | A | A | A |

TABLE 2-continued

| | tan δ (100° C.) | tan δ (130° C.) | G' (100° C.) | G' (160° C.) | Tg (° C.) | Nip Time (msec) | Image Quality | Low-temperature Fixability | Hot Offset Resistance | Gloss Evenness | Heat-resistanet Storage Stability |
|---|---|---|---|---|---|---|---|---|---|---|---|
| Example 7 | 1.6 | 1.3 | $3.0 \times 10^4$ | $5.0 \times 10^2$ | 53 | 55 | A | B | B | B | A |
| Example 8 | 1.7 | 1.4 | $2.5 \times 10^4$ | $4.5 \times 10^2$ | 52 | 55 | A | B | C | B | A |
| Example 9 | 1.5 | 1.3 | $2.8 \times 10^4$ | $5.1 \times 10^2$ | 54 | 55 | A | B | B | B | A |
| Example 10 | 1.8 | 1.5 | $8.0 \times 10^3$ | $1.1 \times 10^3$ | 51 | 55 | A | A | C | B | C |
| Example 11 | 1.9 | 1.5 | $7.4 \times 10^3$ | $1.0 \times 10^3$ | 51 | 55 | A | A | B | B | C |
| Example 12 | 1.8 | 1.4 | $8.2 \times 10^3$ | $1.2 \times 10^3$ | 52 | 55 | A | A | C | B | C |
| Example 13 | 1.8 | 1.5 | $7.6 \times 10^3$ | $2.8 \times 10^2$ | 49 | 55 | A | A | C | B | C |
| Example 14 | 1.9 | 1.6 | $6.0 \times 10^3$ | $2.2 \times 10^2$ | 48 | 55 | A | A | C | B | C |
| Example 15 | 1.7 | 1.5 | $8.0 \times 10^3$ | $2.9 \times 10^2$ | 49 | 55 | A | A | C | B | C |
| Example 16 | 1.8 | 1.7 | $3.8 \times 10^3$ | $1.1 \times 10^2$ | 44 | 55 | A | A | C | B | C |
| Example 17 | 1.9 | 1.8 | $3.1 \times 10^3$ | $1.0 \times 10^2$ | 43 | 55 | A | A | C | B | C |
| Example 18 | 1.8 | 1.7 | $4.0 \times 10^3$ | $1.1 \times 10^2$ | 44 | 55 | A | A | C | B | C |
| Comparative Example 1 | 1.7 | 2.8 | $2.3 \times 10^3$ | $1.1 \times 10^2$ | 42 | 55 | A | A | C | C | C |
| Comparative Example 2 | 1.8 | 3 | $2.1 \times 10^3$ | $1.0 \times 10^2$ | 41 | 55 | A | A | C | C | C |
| Comparative Example 3 | 1.7 | 2.6 | $2.4 \times 10^3$ | $1.2 \times 10^2$ | 43 | 55 | A | A | C | C | C |
| Comparative Example 4 | 0.9 | 1.2 | $1.2 \times 10^5$ | $1.2 \times 10^3$ | 59 | 55 | D | D | A | B | B |
| Comparative Example 5 | 1 | 1.5 | $1.0 \times 10^5$ | $1.1 \times 10^3$ | 58 | 55 | D | D | A | B | B |
| Comparative Example 6 | 0.9 | 1.7 | $1.1 \times 10^5$ | $1.2 \times 10^3$ | 59 | 55 | D | D | A | B | B |
| Comparative Example 7 | 0.7 | 0.8 | $1.3 \times 10^5$ | $1.5 \times 10^3$ | 59 | 55 | D | D | A | A | A |
| Comparative Example 8 | 0.8 | 0.9 | $1.2 \times 10^5$ | $1.4 \times 10^3$ | 58 | 55 | D | D | A | A | A |
| Comparative Example 9 | 0.7 | 0.8 | $1.2 \times 10^5$ | $1.4 \times 10^3$ | 59 | 55 | D | D | A | A | A |

It is clear from Tables 1 and 2 that the toners of Examples have improved in color reproducibility, low-temperature fixability, hot offset resistance, heat-resistant storage stability, and gloss evenness at higher levels compared to those of Comparative Examples.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A non-magnetic toner comprising:

a polyester resin;

a release agent; and a colorant, wherein a storage elastic modulus at 100° C. (G'(100° C.)) of the toner is from $1.0\times10^3$ to $1.0\times10^6$ Pa, wherein a storage elastic modulus at 160° C. (G'(160° C.)) of the toner is from $1.0\times10^2$ to $1.0\times10^4$ Pa, wherein a ratio of loss elastic modulus to storage elastic modulus at 100° C. (tan δ(100° C.)) of the toner is greater than a ratio of loss elastic modulus to storage elastic modulus at 130° C. (tan δ(130° C.)), and wherein the tan δ(100° C.) and the tan δ(130° C.) are each within the range of from 1 to 2.

2. The toner of claim 1, wherein the G'(100° C.) is in the range of from $1.0\times10^4$ to $1.0\times10^6$ Pa.

3. The toner of claim 1, wherein the G'(160° C.) is in the range of from $1.0\times10^3$ to $1.0\times10^4$ Pa.

4. The toner of claim 1, wherein the toner has a glass transition temperature of from 45° C. to 63° C., the glass transition temperature determined from a differential scanning calorimetric curve obtained in a first heating of the toner in a differential scanning calorimetry.

5. A developer comprising the toner of claim 1.

6. An image forming apparatus comprising:

an electrostatic latent image bearer;

a charger to charge a surface of the electrostatic latent image bearer;

an irradiator to irradiate the charged surface of the electrostatic latent image bearer to form an electrostatic latent image;

a developing device containing the toner of claim 1, to develop the electrostatic latent image into a toner image with the toner;

a transfer device to transfer the toner image onto a recording medium; and a fixing device to fix the toner image on the recording medium.

7. The image forming apparatus of claim 6, wherein the fixing device includes a nip portion configured to pressurize the toner image on the recording medium for a nip time of 35 msec or more to fix the toner image on the recording medium.

8. A process cartridge detachably mountable to an image forming apparatus, comprising:

an electrostatic latent image bearer; and a developing device containing the toner of claim 1, to develop an electrostatic latent image formed on the electrostatic latent image bearer into a toner image with the toner.

9. The toner of claim 1, wherein the polyester resin comprises a first polyester resin having a glass transition temperature (Tg) of from −60° C. to 70° C., and a second polyester resin having a glass transition temperature (Tg) of 20° C. or greater.

10. The toner of claim 9, wherein the first polyester resin has the glass transition temperature (Tg) of from −40° C. to 0° C., and the second polyester resin has the glass transition temperature (Tg) of from 30° C. to 80° C.

11. The toner of claim 10, wherein the first polyester resin is insoluble in tetrahydrofuran, and the second polyester resin is soluble in tetrahydrofuran.

12. The toner of claim 10, wherein the first polyester resin has a weight average molecular weight of from 20,000 to 10,000,000, and the second polyester resin has a weight average molecular weight of from 3,000 to 30,000.

13. The toner of claim 10, wherein the first polyester resin is included in an amount of from 10% to 30% by mass, and the second polyester resin is included in an amount of from 40% to 80% by mass, relative to the mass of the toner.

14. The toner of claim 10, wherein the first polyester resin is included in an amount of from 10% to 20% by mass, and the second polyester resin is included in an amount of from 60% to 80% by mass, relative to the mass of the toner.

15. The toner of claim 9, wherein the first polyester resin has the glass transition temperature (Tg) of from −40° C. to 0° C., and the second polyester resin has the glass transition temperature (Tg) of from 45° C. to 70° C.

16. The toner of claim 1, wherein the G'(100° C.) is in the range of from $1.0\times10^4$ to $1.0\times10^6$ Pa, and the G'(160° C.) is in the range of from $1.0\times10^3$ to $1.0\times10^4$ Pa.

17. The toner of claim 1, wherein the tan δ(100° C.) and the tan δ(130° C.) are each within the range of from 1.2 to 1.7.

* * * * *